US005778568A

United States Patent [19]

Toyoshima

[11] Patent Number: 5,778,568

[45] Date of Patent: Jul. 14, 1998

[54] CARRY SCRAPER SHIPS

[76] Inventor: Kaneto Toyoshima, 66-1, Aza-Kitahara, Donari-cho, Itano-gun, Tokushima-ken, Japan

[21] Appl. No.: 511,610

[22] Filed: Aug. 4, 1995

[51] Int. Cl.[6] ..... E02F 3/14

[52] U.S. Cl. ..... 37/345; 37/338; 37/346

[58] Field of Search ..... 37/312, 313, 314, 37/336, 337, 338, 340, 341; 114/48.1, 74 A, 222, 248; 210/605, 606, 609, 612; 56/8, 9

[56] References Cited

U.S. PATENT DOCUMENTS

| | | | |
|---|---|---|---|
| 2,094,535 | 9/1937 | Harrison | 56/8 |
| 2,991,750 | 7/1961 | Tourneau | 37/346 X |
| 3,146,537 | 9/1964 | Von Bolbar | 37/338 X |
| 3,706,185 | 12/1972 | Chaplin | 56/9 |
| 4,185,404 | 1/1980 | Hue et al. | 37/34 X |
| 4,202,119 | 5/1980 | Grace | 37/338 |
| 4,676,052 | 6/1987 | Hawk | 37/341 |
| 5,259,130 | 11/1993 | Rohr | 37/338 |
| 5,311,682 | 5/1994 | Sturdivant | 37/346 X |
| 5,487,258 | 1/1996 | McNabb | 56/9 |

*Primary Examiner*—Terry Lee Melius
*Assistant Examiner*—Robert Pezzuto
*Attorney, Agent, or Firm*—Wood, Phillips, VanSanten, Clark Mortimer

[57] ABSTRACT

A carry scraper ship having a tug lighter for towing, a device for scraping and lifting earth and sand accumulated on ground under water, a bucket conveyor for conveying earth and sand scraped and lifted from ground under water to an atmospheric environment above water, a belt conveyor lighter for discharging earth and sand conveyed from under water to the atmospheric environment onto earth carriers, and a structure for linking the tug lighter, the device for scraping and lifting, the bucket conveyor and the belt conveyor light together in operative relationship.

17 Claims, 26 Drawing Sheets

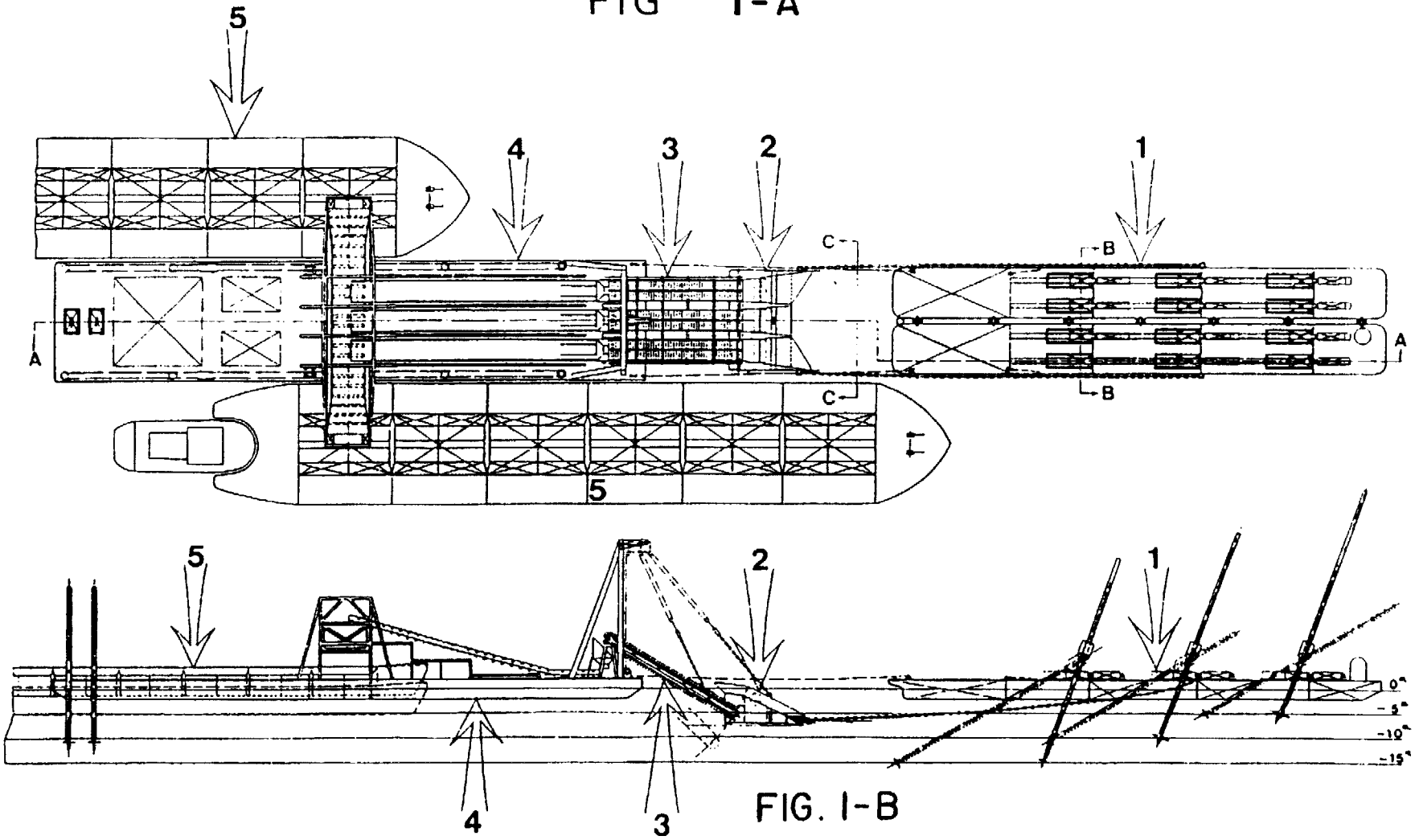
FIG 1-A
FIG. 1-B

FIG 2-A
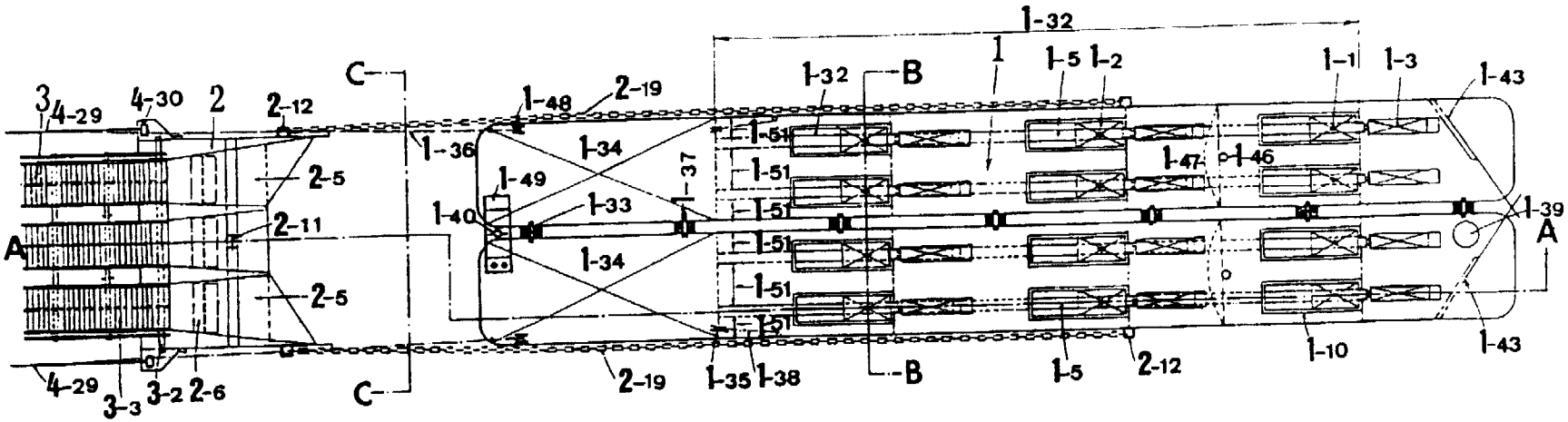

FIG 2-B
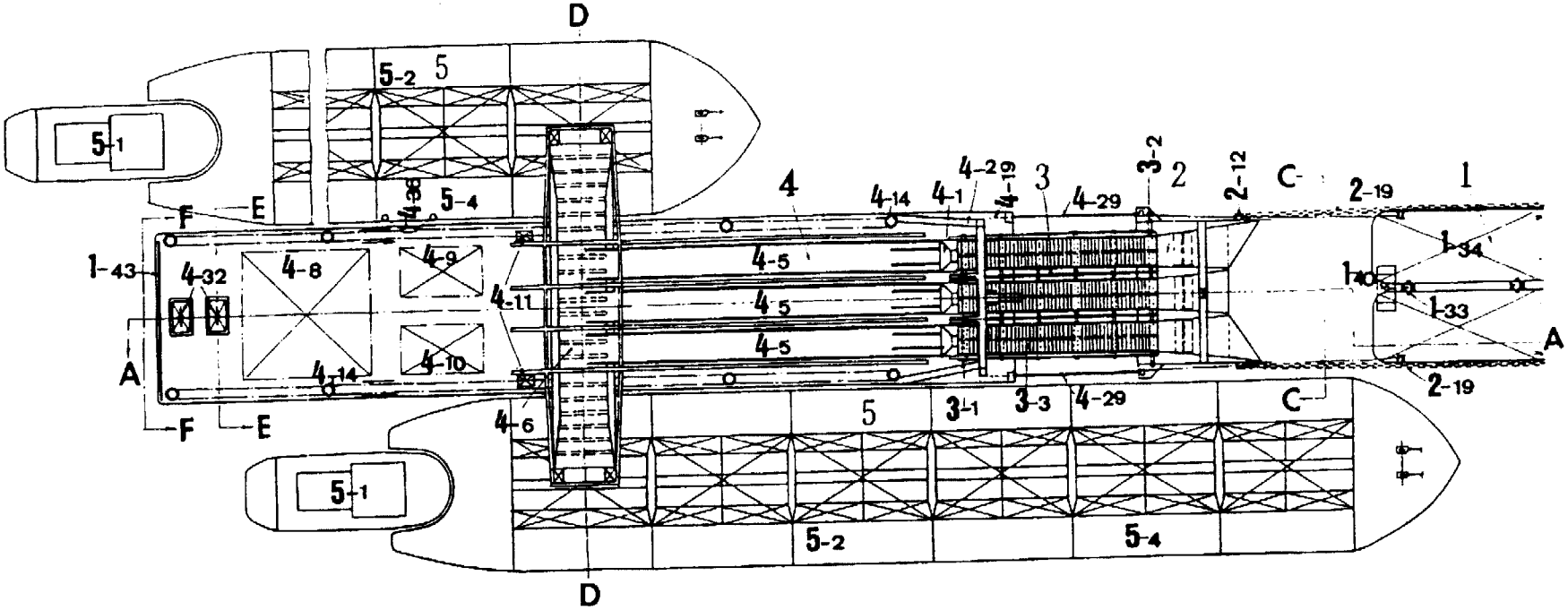

FIG 2-C
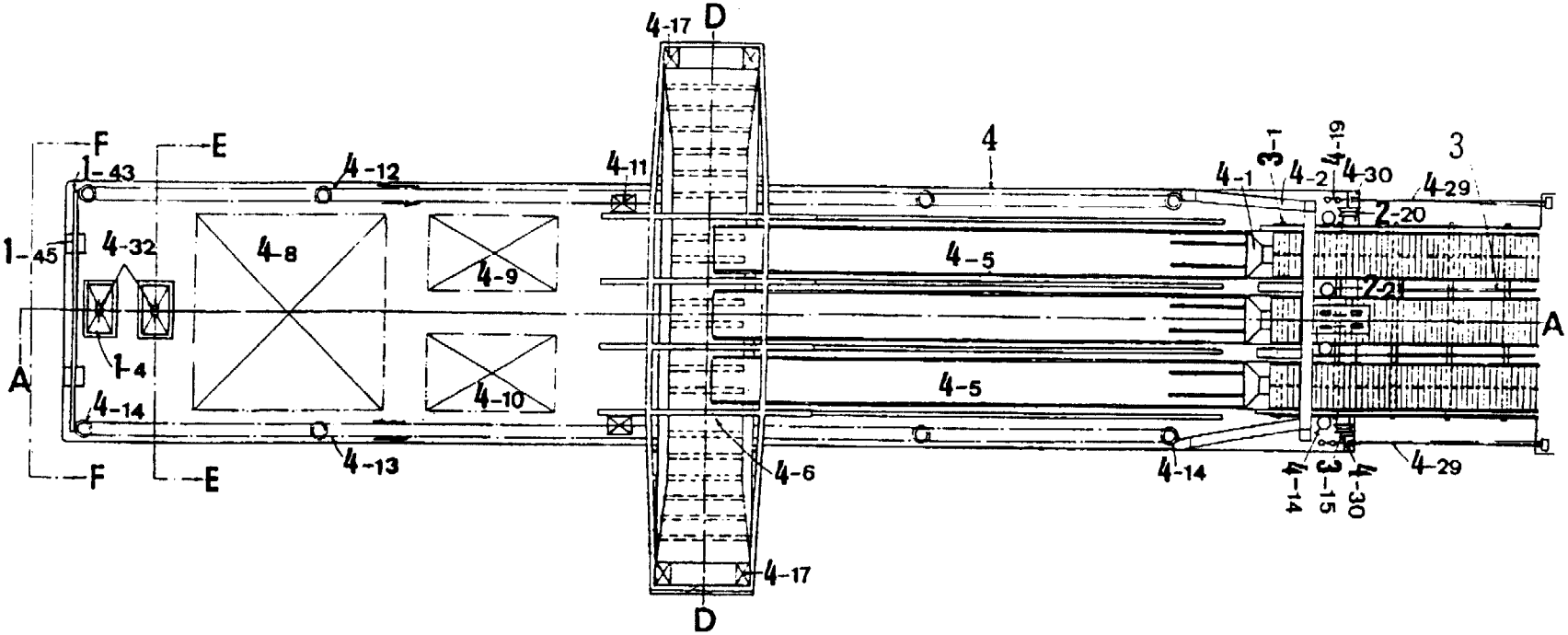

FIG 3-A
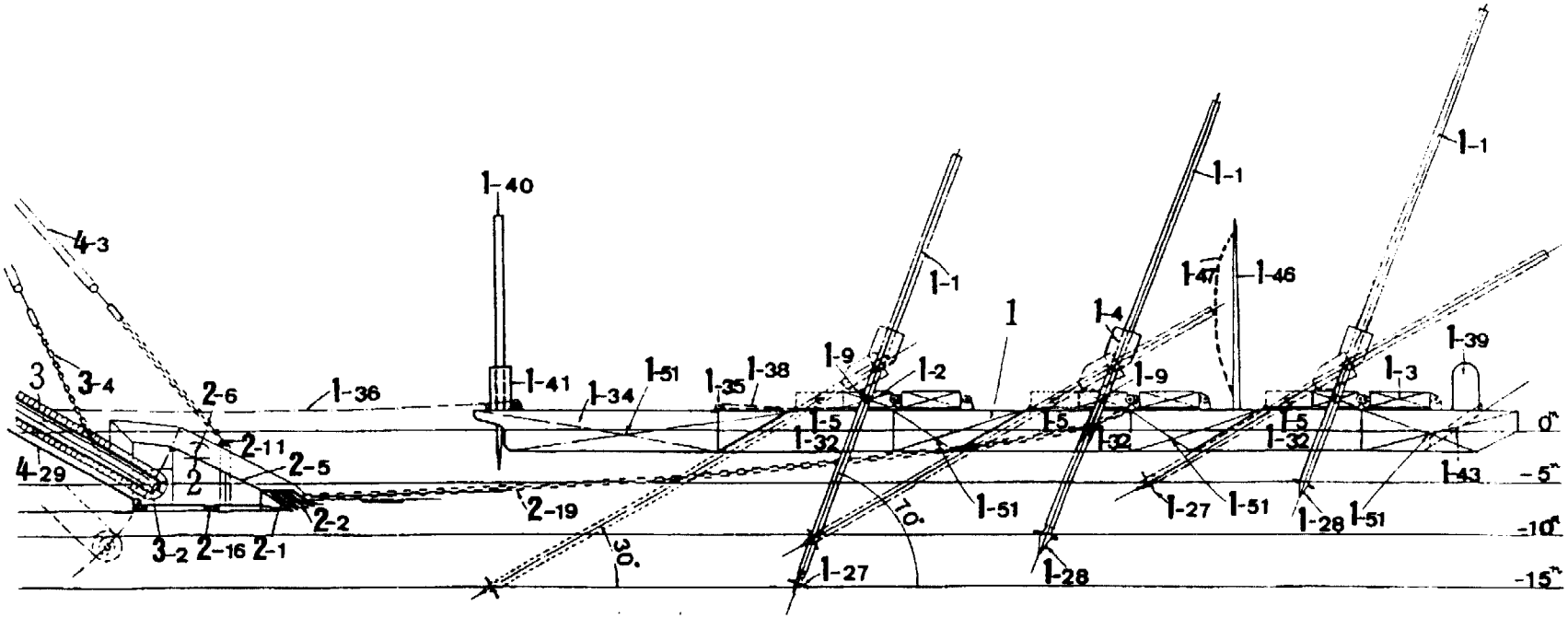

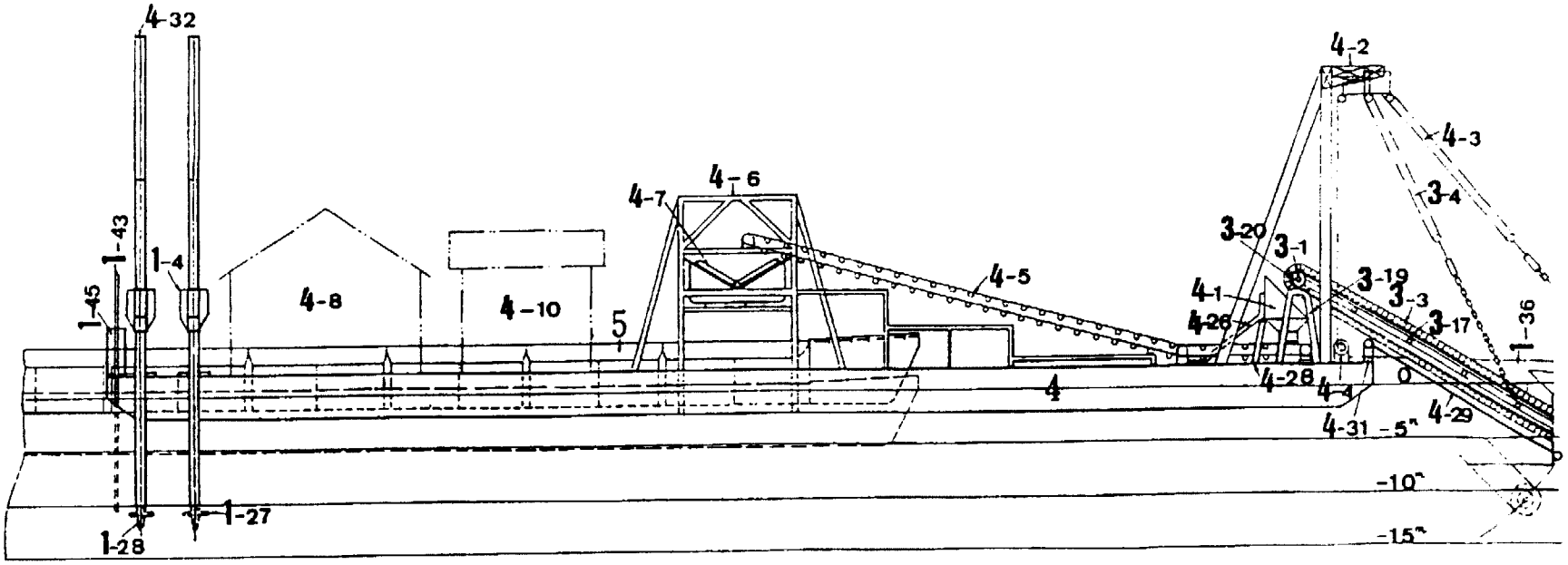
FIG 3-B

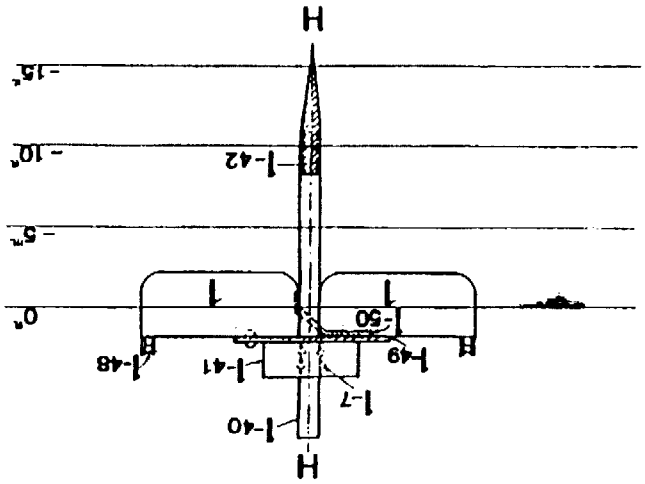
FIG. 5-B
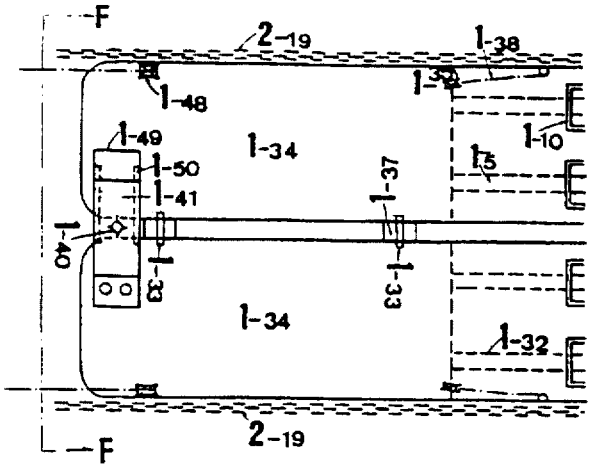
FIG. 5-A
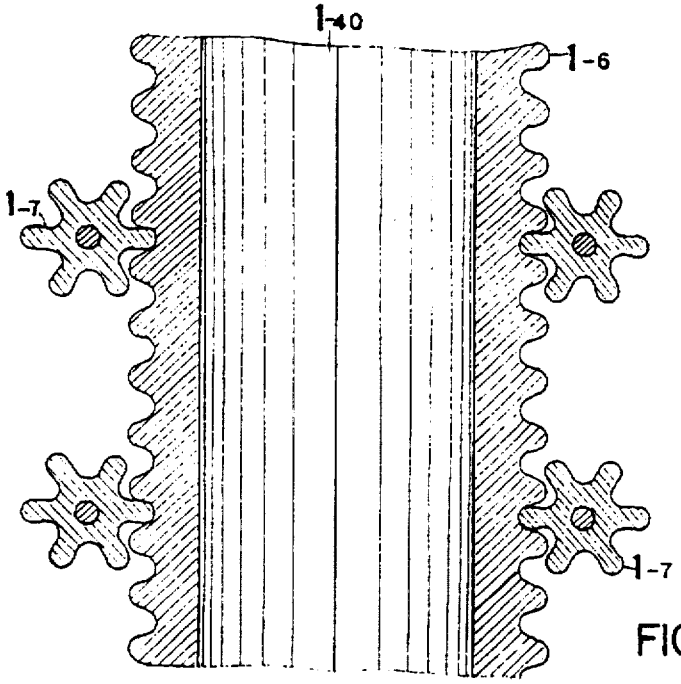
FIG. 5-C
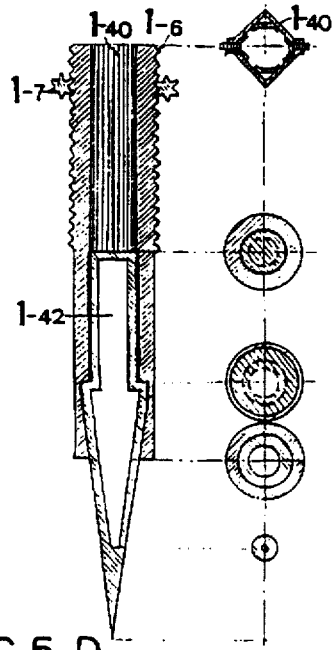
FIG. 5-D
FIG. 5-E

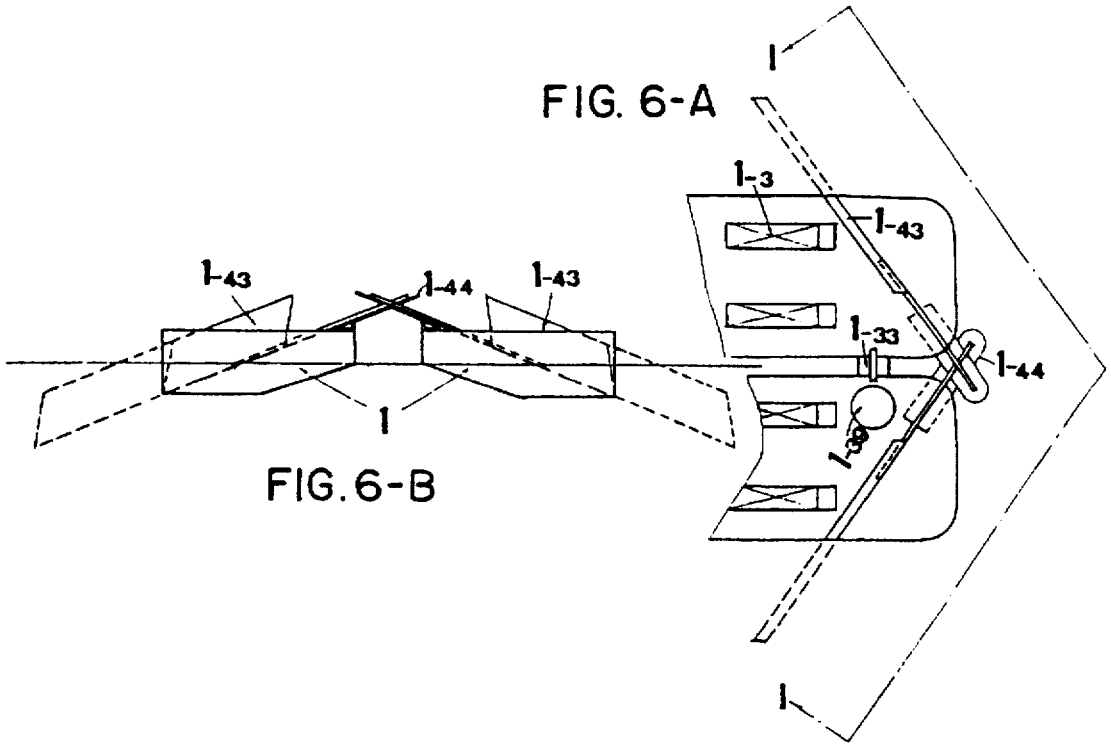
FIG. 6-A
FIG. 6-B
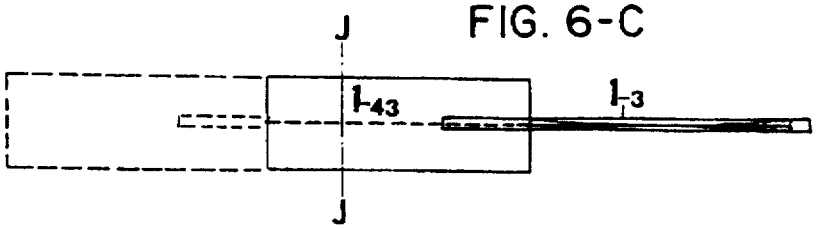
FIG. 6-C
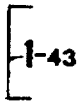
FIG. 6-D
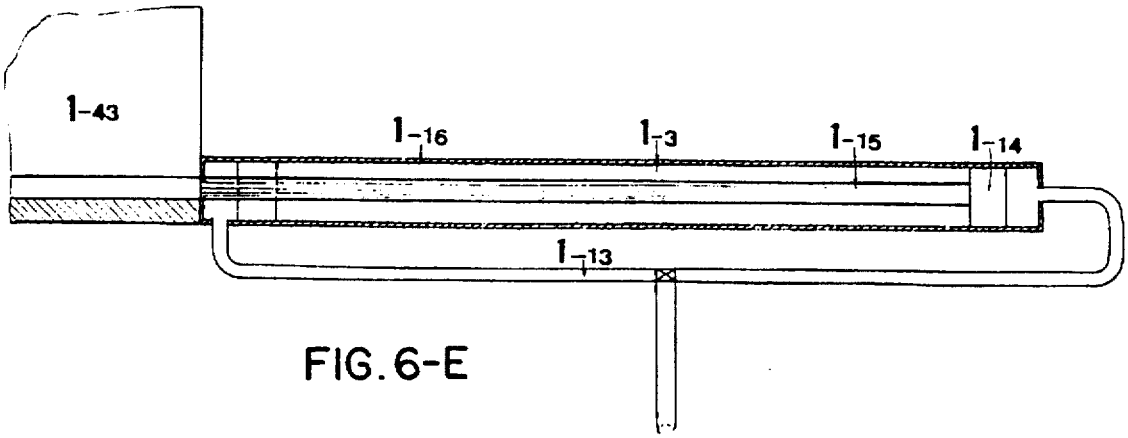
FIG. 6-E FIG 23
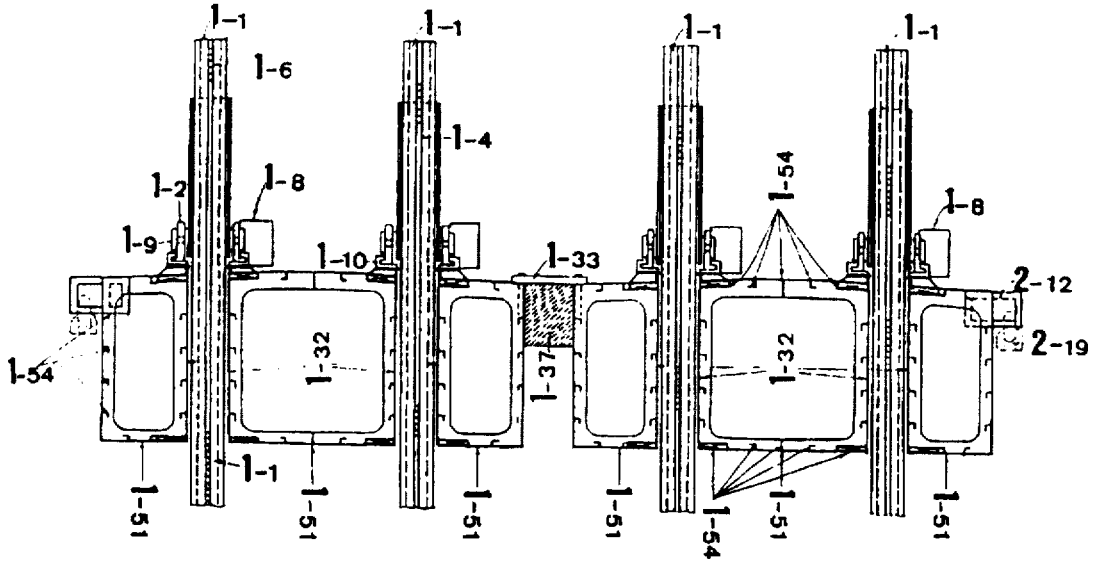
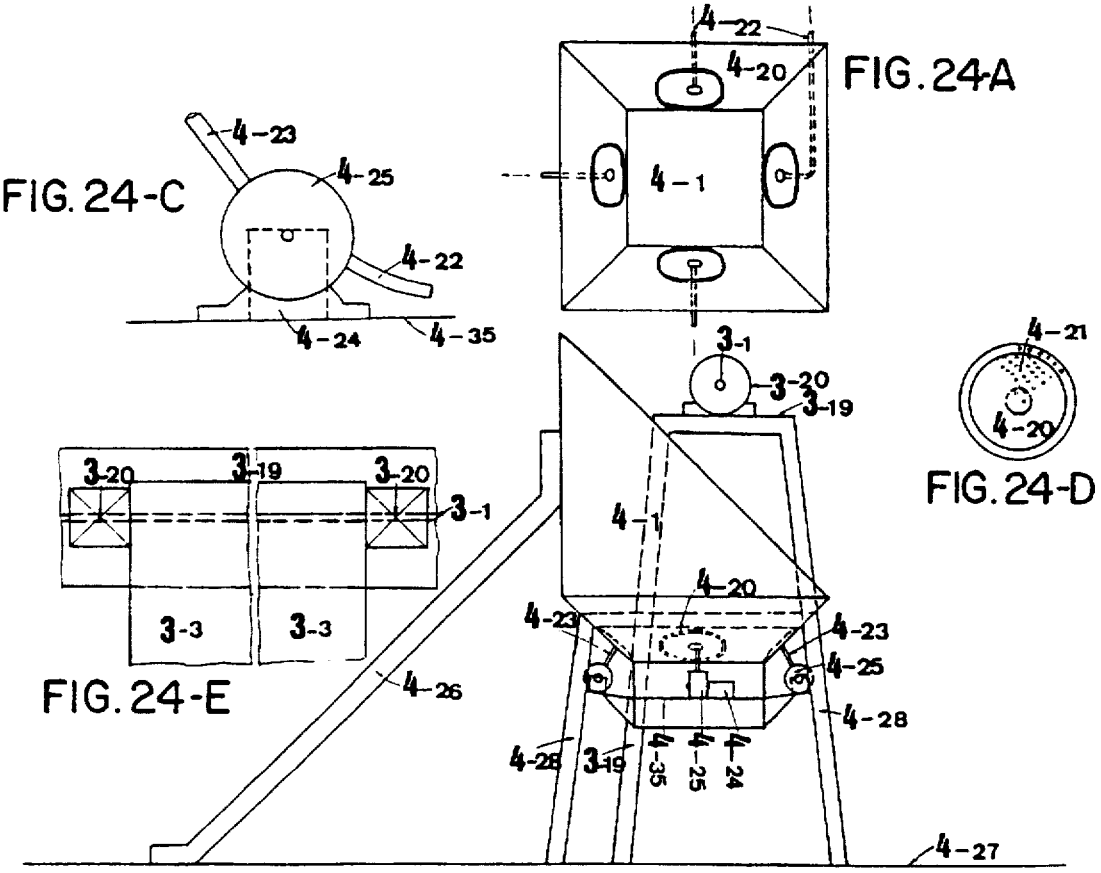
FIG. 24-A
FIG. 24-C
FIG. 24-D
FIG. 24-E
FIG. 24-B

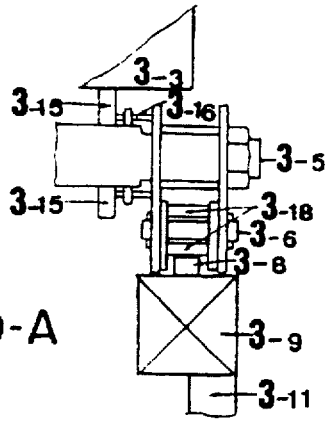
FIG. 29-A
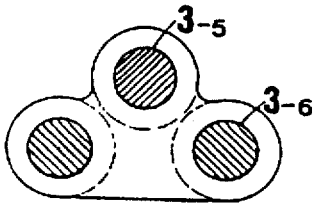
FIG. 29-B
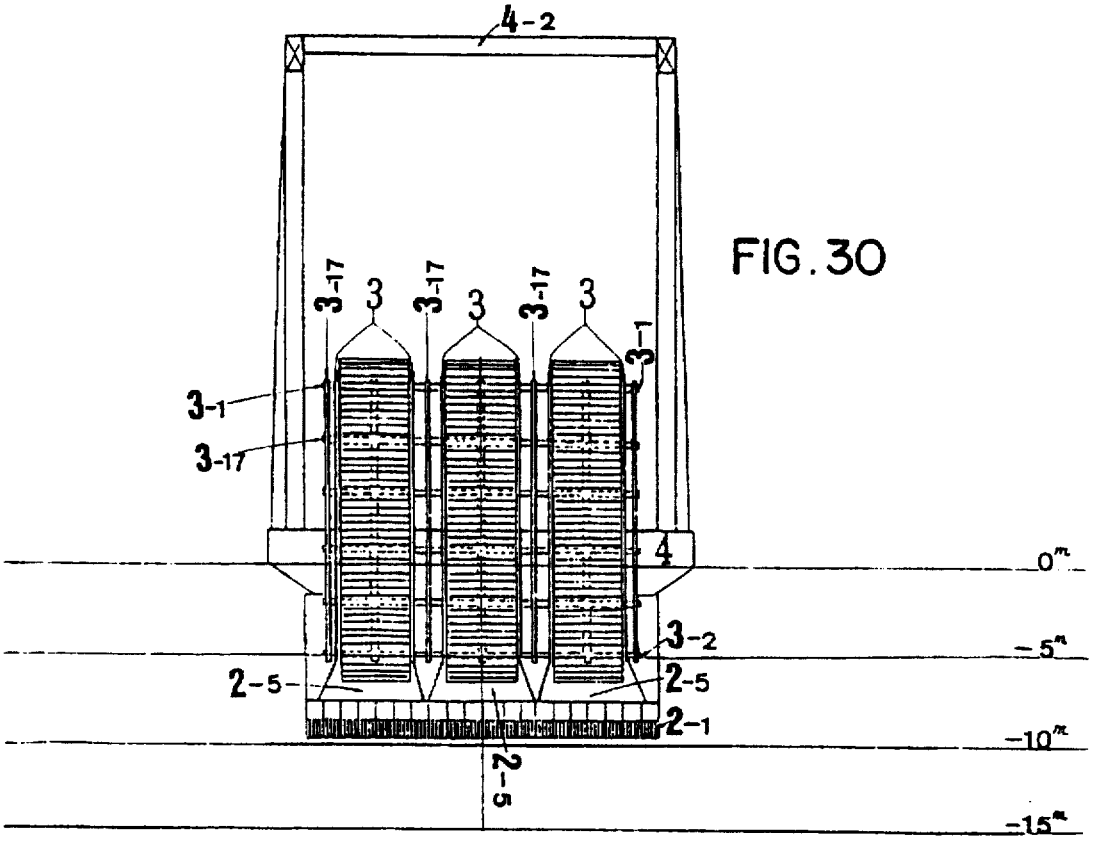
FIG. 30

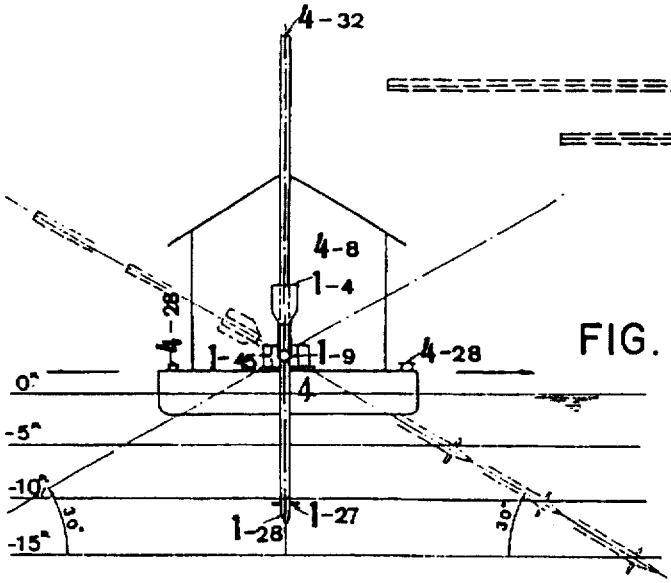
FIG. 31-A
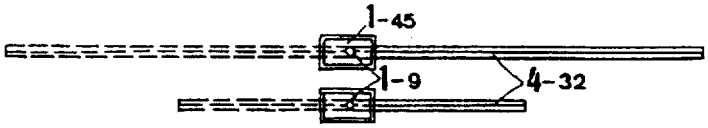
FIG. 31-B
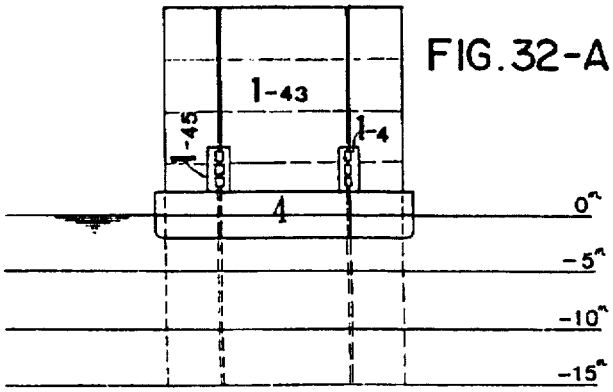
FIG. 32-A
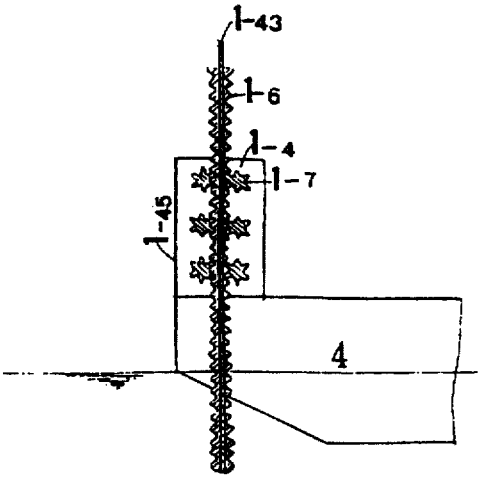
FIG. 32-B

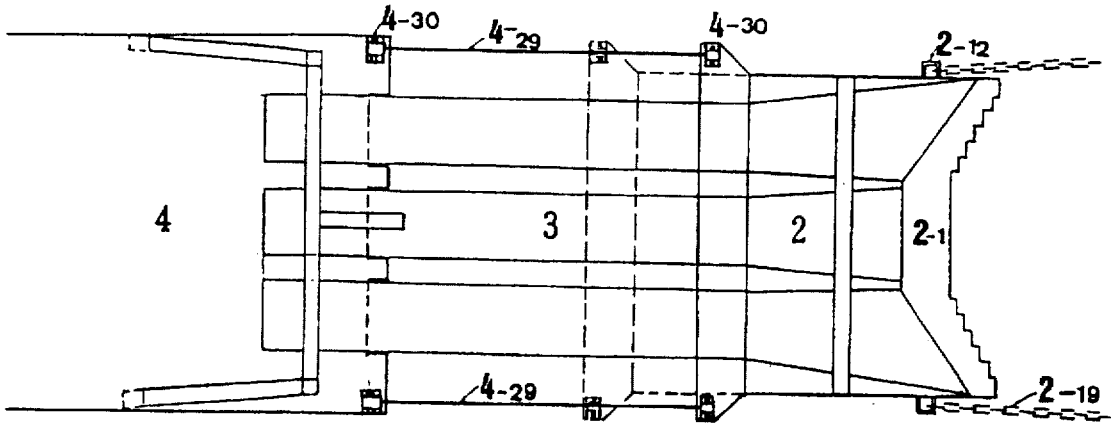
FIG. 33-A
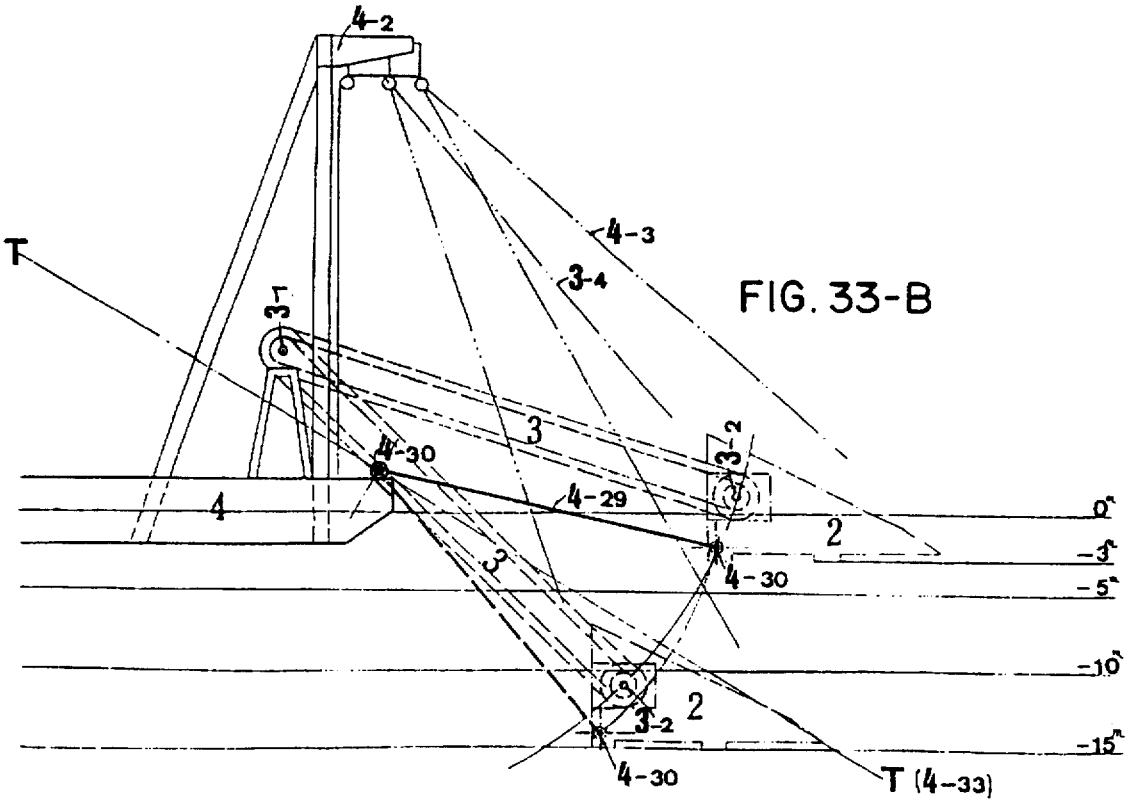
FIG. 33-B

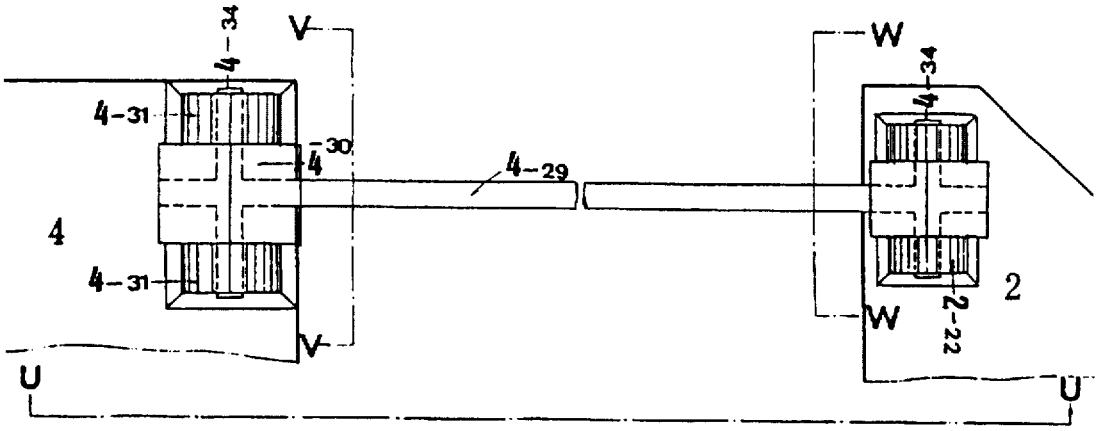
FIG. 33-C
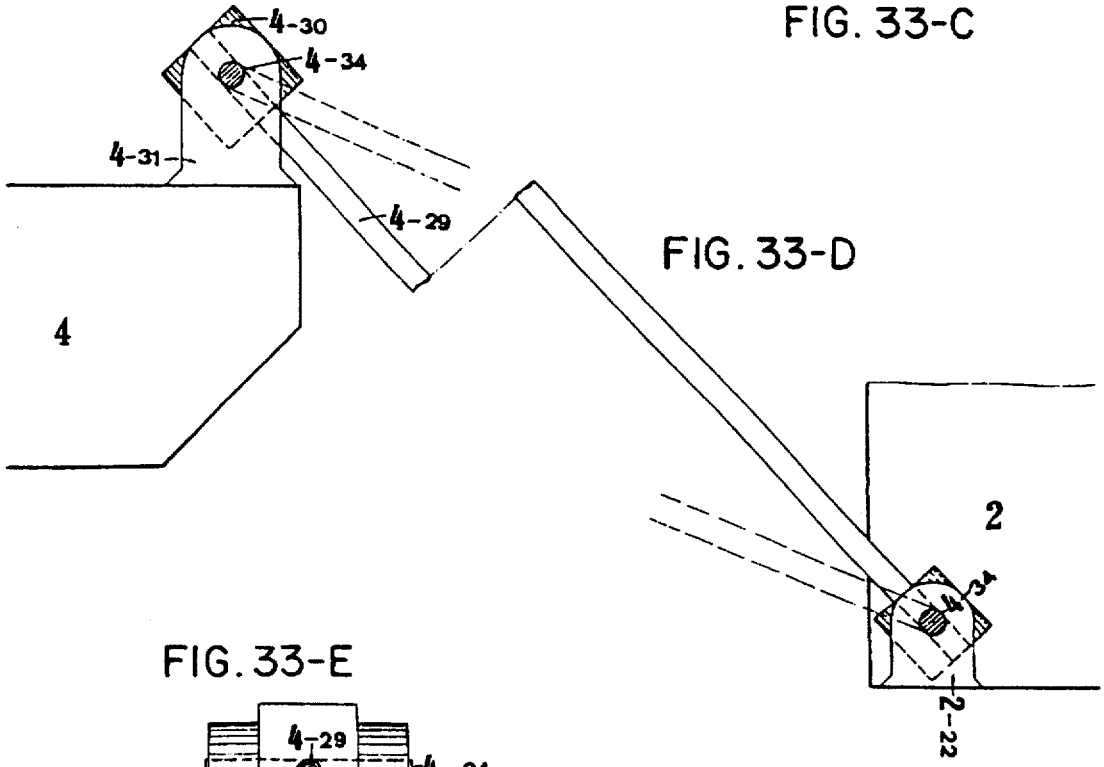
FIG. 33-D
FIG. 33-E
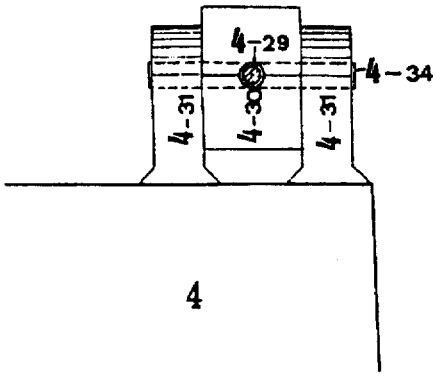
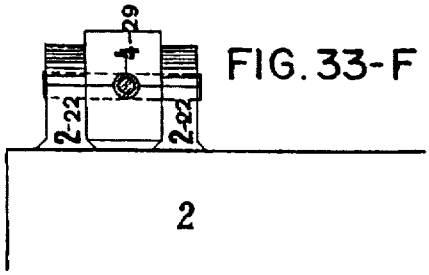
FIG. 33-F

CARRY SCRAPER SHIPS

BACKGROUND OF THE INVENTION

1. Field of the Invention

The present invention relates to public engineering work vessels capable of scraping large volume of earth/sand in a short period of time which has accumulated on the bottom of water. More specifically, the invention relates to a fleet of ships for scraping large volume of earth and sand from river bed and transporting it to a predetermined location.

2. Description of the Related Art

There are a number of well-known huge rivers on the earth such as the Mississipi River, the Columbia River, the Amazon River, the Zaire River, the Yangtze (Chang Jiang) River, the Yellow (Huang He) River, the Laplata River, the Nile River, the Ob' River, the Brahmaputra River, etc. These huge rivers have been made available for aquatic traffic from ancient times.

Availing of certain depth, large vessels can cruise on some of the above-cited huge rivers such as the Mississipi River and the Yangtze River for example. Nevertheless, in the Yangtze River and the Yellow River huge volume of earth and sand flow down from upstream sides every year and then accumulate themselves near estuary, and as a result, river bed near the estuary has become shallow to cause each ship to hardly cruise on the Yangtze River. For example, any ship having more than 10,000 gross tons is obliged to wait for the rising tide until the water depth reaches 7 through 9 meters before it can enter a predetermined port. In the case of the Yellow River, as a result of the promoted accumulation of earth and sand, actually, any vessel cannot cruise on the river water, and yet, river bed on the upstream side has risen as a whole to oblige river-side embankments to be reinforced voluminously. Nevertheless, river beds are already higher than earth surface outside of embankments by several meters. Since there is a certain limit in the voluminous reinforcement of embankments, potential danger in terms of breakdown of embankments is imminent.

In order to secure cruising route for large vessels and lower the lifted river beds, it is necessary to wholly remove earth and sand accumulated on river bed near estuary. However, since there is such a tremendously large amount of earth and sand that should be removed, it is totally impossible to remove it at a stretch even when exerting full operating capacity of all the public engineering work ships. And yet, unexpected increase of river water beyond prediction may cause all the dredging results to be reduced to naught. Rivers are subject to rainy season and dry season. Since unexpected heavy rain causes large volume of earth and sand to flow into near estuary from upstream side, it is imperative that river beds be properly renovated within a short period of time during dry season. In order to properly renovate river beds, it is of course necessary to jointly execute sand-proof works in all the basins of the objective river and prevent earth and sand from flowing through river beds. However, there is no means to fully solve problems other than removal of sand and earth accumulated during long periods of past time.

Accordingly, earth and sand accumulated on river beds are generally removed by operating public engineering work ships. Any conventional public engineering work ship has a floating hull secured with spuds and wire ropes. For example, the Japanese Laid-Open Patent Publication No. SHO-59-179483 (1984) discloses an apparatus for shifting a platform ship by means of a transferable spud base. However, it takes much labor and time to secure hull of each public engineering work ship with spuds or wire ropes, and yet, operation is executed solely in the periphery of each work ship and much time is lost in the shift of the work ship. Furthermore, any conventional public engineering work ship is devoid of capability to remove more amount of earth and sand per unit hour than the amount of earth and sand flowed from upstream side and accumulated per unit hour.

Therefore, it is quite important to improve working capability of each public engineering work ship. However, it is more important to study on methods for effectively operating public engineering work ships. In order to effectively remove earth and sand, minute planning is also required. Taking the case of the Yellow River for concrete example to schematize the planning, initially, based on precise topographical map of the river bottom, position of the shortest distance from the estuary is confirmed at past river bottom substantially in the center of gulf from the center of the estuary. The offing from this geographical point suddenly becomes very deep. A plan is set up to provide a substantially linear channel from the neighborhood of the estuary to this geographical point.

In the case of the estuary portion of the Yangtze River, concretely in the case of Shanghai city, a channel (flow center) is dredged substantially in the center of the existing cruising route. The channel is formed by plowing out the existing river bottom by 5 meters of depth and 200 meters of width. In this case, sectional area ranges from 1000 $m^2$ to 2000 $m^2$, and thus, if earth and sand were removed for 200 km of length, total volume of removed earth/sand will reach 200 million through 400 million cubic meters.

Even though the total volume of earth/sand ranges from 200 million to 400 million cubic meters, removal work can fully be achieved by operating several working ships with allout efforts during dry season ranging for 7 to 8 months except for rainy season. Even if there were unexpected flow of water on the way of executing the pre determined dredging work, since the channel is plowed out from the offing side, there is no potential danger that may reduce all the results to naught. Rather, owing to action of flowing water, erosion of channel is promoted in the vertical and horizontal directions, and thus, availing of natural force such as tide and flow, earth and sand can be transferred to the offing without accumulation of earth and sand flowed from upstream side. Since the formed channel has 200 meters of width, the channel enables vessels to smoothly cruise themselves. Once the channel has been formed, substantially 80% of the object for renovating river bed has been achieved.

When the following dry season starts, work for dredging channel is executed towards estuary portion from the farthest upstream point. The dredging work in this dry season provides the channel with such a width one half (approximately 100 meters) the last one. Owing to carrying force of water flowing through the channel or carrying force of tide current, descent of river bed can quickly be realized.

The Applicant related to the present invention had disclosed such an apparatus for powerfully propelling a special underwater public engineering ship capable of dealing with large volume of earth and sand of a huge river via the Japanese Patent Publication No. Hei-6-49478 (1994), for which the Japanese Patent No. 1920937 has duly been granted. Previously, the Chinese Patent (Reg. No. 5,944) was granted to an analogous apparatus on Jun. 13th, 1990, in the People's Republic Of China, which was titled "Working Ship With Mechanical Rod Poling Device".

SUMMARY OF THE INVENTION

The object of the invention is to provide "carry scraper ships" capable of removing large volume of earth and sand accumulated on the bottom of water and reclaiming new land in high demand within an identical bay.

A tug lighter equipped with steel rods tugs the following scraper unit, a bucket conveyer, and a belt-conveyer lighter. Since the tug lighter and the belt-conveyer lighter are powerfully propelled by action of the steel rods, they can smoothly cruise through estuary of shallow river bed or bay as well.

Front end of the scraping device is provided with replaceable blades each being equipped with a square scraper biting into river bottom. The square scraper softens water-bottom earth and sand solidified by hydropressure applied thereto for a long period of time. An earth/sand lifting platform tilted from the front end to the rear end is provided. Earth and sand softened by the square scraper are carried backward onto the earth/sand lifting platform in the state being pushed by earth/sand scraped in succession.

A bucket conveyer endlessly conveying earth/sand is disposed between rear-end lower portion of the earth/sand lifting platform and the bow of the belt-conveyer lighter. Earth and sand conveyed to the rear end of the earth/sand lifting platform fall onto the following bucket conveyer and then transferred onto the belt-conveyer lighter.

The belt conveyer lighter is equipped with a belt conveyer conveying earth/sand in the longitudinal direction thereof and another belt conveyer shifting earth/sand in the widthwise direction thereof. These belt conveyers respectively receive the other belt conveyer for shifting earth/sand in the longitudinal direction thereof. A sleeve (discharger) having both ends extended from the width of the hull is formed. Earth and sand transferred on the belt-conveyer lighter are loaded on an earth freighter brought into contact with said lighter.

The carry scraper ships according to the invention comprises a tug lighter which is equipped with steel rods and capable of powerfully tugging a scraper unit, a bucket conveyer, and a belt-conveyer lighter, and said scraper unit which is capable of scraping earth and sand without scattering them owing to said powerful tugging effect. In other words, the invention is the result of combining useful characteristics of the both units.

BRIEF DESCRIPTION OF THE DRAWINGS

FIG. 1*a* is an overall plan representing overall disposition of the carry scraper ships according to the invention;

FIG. 1*b* is a cross-sectional view taken on line A—A of FIG. 1;

FIG. 2-A is an enlarged plan centering the tug lighter;

FIG. 2-B is a plan representing the state in which an earth freighter is brought into contact with the belt conveyer lighter;

FIG. 2-C is an enlarged plan centering the belt-conveyer lighter;

FIG. 3-A is a cross-sectional view taken on line A—A of FIG. 2-A;

FIG. 3-B is a cross-sectional view taken on line A—A of FIG. 2-C;

FIG. 5*a* is a plan of the bow of the tug lighter;

FIG. 5*b* is a lateral view of the bow taken on line F—F shown in FIG. 5*a;*

FIG. 5C is an enlarged sectional view of the spuds;

FIG. 5*d* is a cross-sectional view of the bow taken on line H—H shown in FIG. 5*b;*

FIG. 5*e* is a cross-sectional view representing respective portions of the bow shown in FIG. 5*d;*

FIG. 6*a* is a plan of bow portion of the tug lighter;

FIG. 6*b* is a lateral view of the bow portion taken on line I—I shown in FIG. 6*a;*

FIG. 6*c* is an enlarged plan of a tide-riding plate;

FIG. 6*d* is a cross-sectional view of the tide-riding plate taken on line J—J shown in FIG. 6*c;*

FIG. 6*e* is an enlarged sectional view of an oil-pressurized cylinder;

FIG. 23 is a cross-sectional view of the replaceable blades taken on line B—B shown in FIG. 2-A;

FIG. 24*a* is a plan of floor hopper;

FIG. 24*b* is a lateral view of the floor hopper;

FIG. 24*c* is an enlarged lateral view of a pump secured to the floor hopper;

FIG. 24*d* is an enlarged plan of a suction board secured to the floor hopper;

FIG. 24*e* is a plan of a support base of a common drive shaft 3-1;

FIG. 29*a* is an enlarged lateral view of a bucket-supporting shaft of the bucket conveyer taken on line Y—Y;

FIG. 29*b* is an enlarged view of the bucket supporting shaft;

FIG. 30 is a front view of the tug lighter taken on line C—C shown in FIG. 2-A;

FIG. 31*a* is a lateral view of the belt-conveyer lighter taken on line E—E shown in FIG. 2-C;

FIG. 31*b* is an enlarged plan of the steel rods used for inversion;

FIG. 32*a* is sectional view of the belt-conveyer lighter taken on line F—F shown in FIG. 2-C;

FIG. 32*b* is a partially enlarged sectional view of the beltconveyer lighter taken on line A—A shown in FIG. 2-C;

FIG. 33Aa is an enlarged plan centering the scraper device representing the state of linkage with the belt conveyer lighter;

FIG. 33Ab is a lateral view representing the state of linkage between the scraper device and the belt-conveyer lighter;

FIG. 33-Bc is a plan centering the connection rods between the scraper device and the belt-conveyer lighter;

FIG. 33-Bd is a lateral view of the connection rods taken on line U—U shown in FIG. 33-Bc;

FIG. 33-Be is a lateral view of the connection rods taken on V—V shown in FIG. 33-Bc; and FIG. 33-Bf is a lateral view of the connection rods taken on line shown in FIG. 33-Bc.

DESCRIPTION OF THE PREFERRED EMBODIMENTS

Figure 4:
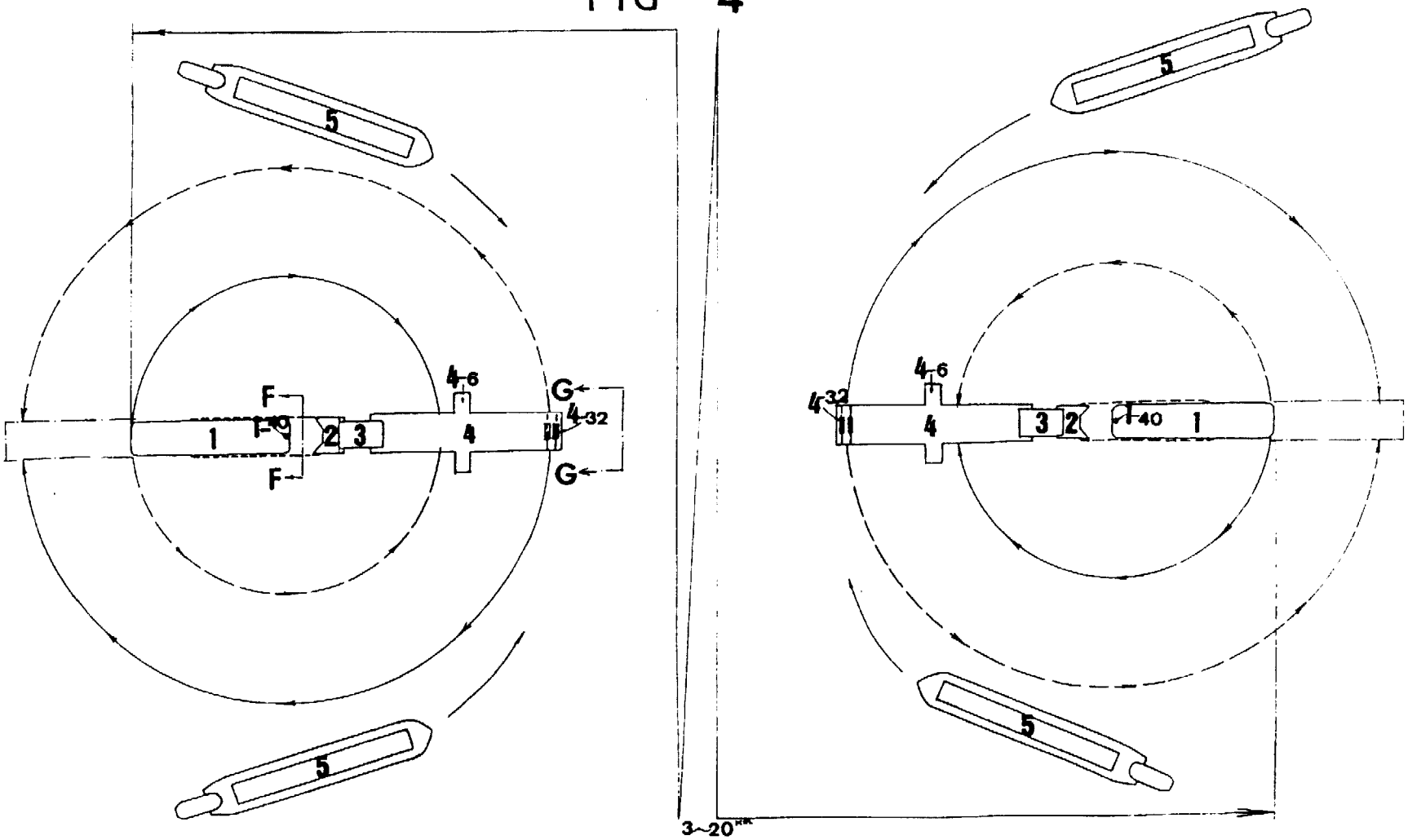
FIG. 4 is a plan representing the state in which the scraper device inverts itself.

As shown in FIG. 1, each of the "carry scraper ships" according to the invention comprises a tug lighter 1, a scraper device 2 for scraping earth and sand accumulated on the water bottom, a bucket conveyer 3 for conveying scraped earth and sand, and a belt-conveyer lighter 4 for discharging conveyed earth and sand onto an earth freighter 5, which are jointly disposed in series.

The carry scraper ships according to the invention are normally operated in rivers having 3 through 15 meters of water depth. When dealing with such a river location having less than 3 meters of water depth, an attachment such as a "bread" is secured to the bow of each of the carry scraper ships, and then, using the bread, the scraper ships respectively press underwater earth. Alternatively, the water-bottom earth/sand scraping/carrying ship (which was duly registered in the People's Republic of China under the registration No. 29,796 granted to the Applicant of the present invention) or the existing "back for ship" is used. Any of these earth scraping/carrying ships can smoothly cruise through navigation route having 15 meters of water depth. If more than 15 meters of water depth is required for navigation route, "dragxaction dredger" is used. End of the aforesaid channel can be referred to as a concrete example of location at which more than 15 meters of water depth should be provided. It is essential that water bottom of such location be scraped periodically.

The tug lighter 1 inserts steel rods 1-1 into water bottom having 3 through 15 meters of water depth and tugs the following belt-conveyer lighter 4. Two kinds of the steel rods 1-1 are prepared including the one which is usable in shallow-depth water in the periphery of bay and the other one usable in deep-water location in the bay. Three ranks of pontoons 1-51 are disposed between the bow and the stern of the tug lighter 1. As shown in FIG. 2A and FIG. 23, based on lengthy longitudinal partitions 1-32 made of thick steel plates, each pontoons 1-51 forms rahmen-structured water-tight space by combining reinforcing members 1-54. The pontoons 1-51 enable the tug lighter 1 to gain the required floating force without being subject to deflection and strain. A camber is provided on the upper deck of the pontoons 1-51 to promote discharge of water. As shown in FIG. 2-A, a plurality of wells 1-5 are provided between respective pontoons 1-51, where the wells 1-5 make up operating space to permit the steel rods 1-1 to swingably ascend and descend themselves. Peripheral portions of the wells 1-5 are sturdily reinforced.

Figure 7:
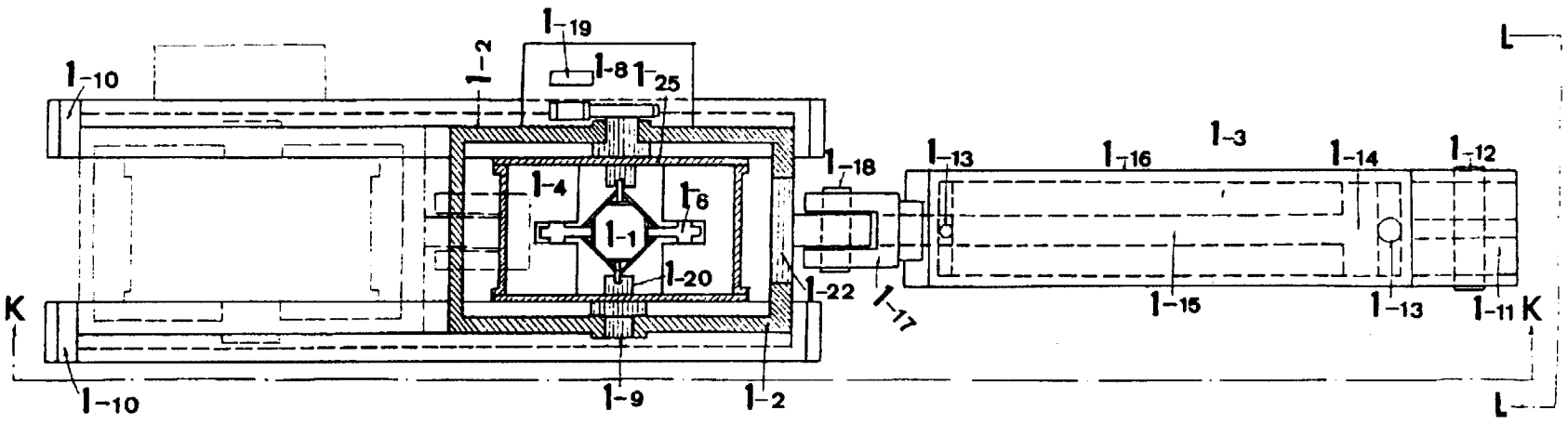
FIG. 7 is a partially sectional plan centering steel rods of the tug lighter.
Figure 8:
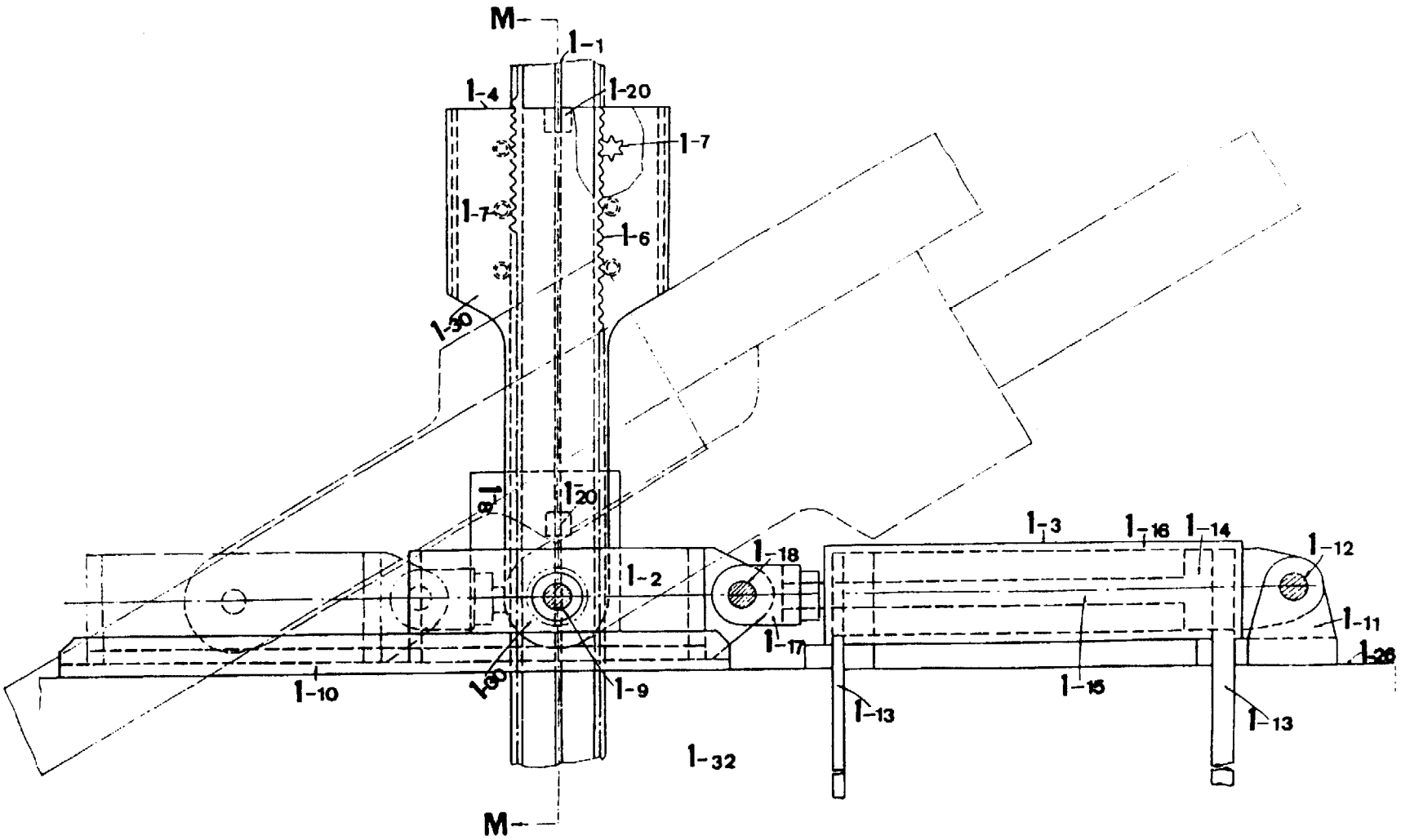
FIG. 8 is a front view of the steel rods taken on line K—K shown in FIG. 7.
Figure 9:
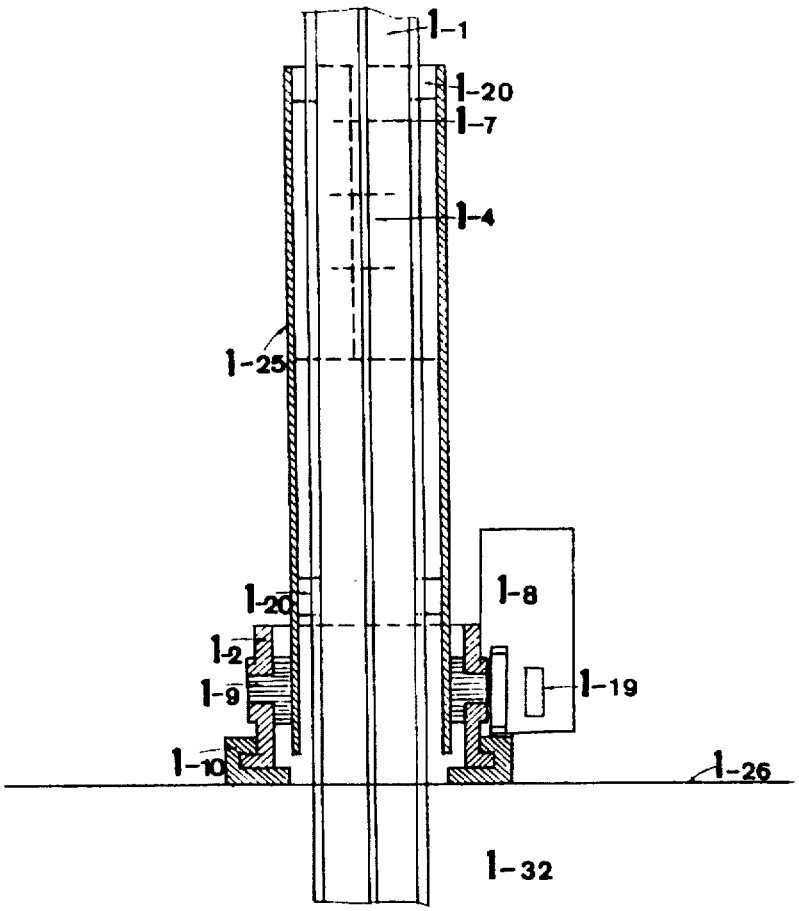
FIG. 9 is a cross-sectional view of the steel rods taken on line M—M shown in FIG. 8.
Figure 10:
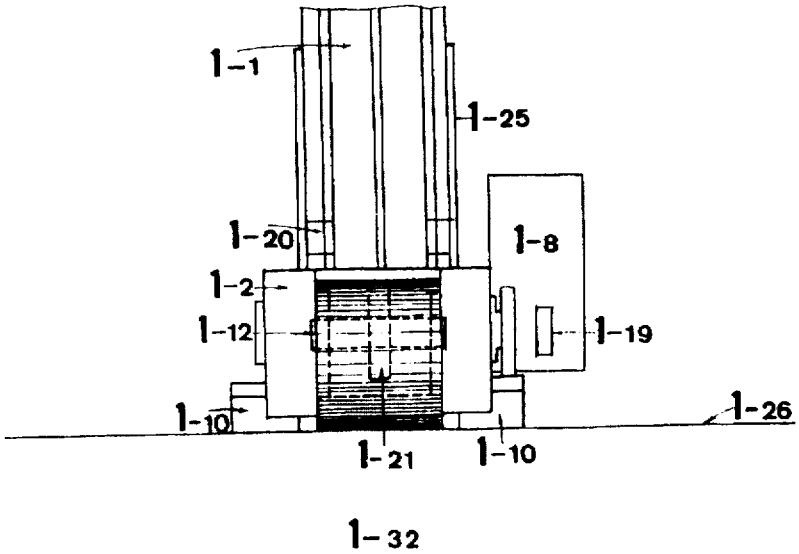
FIG. 10 is a front view of the steel rods taken on line L—L shown in FIG. 7.
Figure 13:
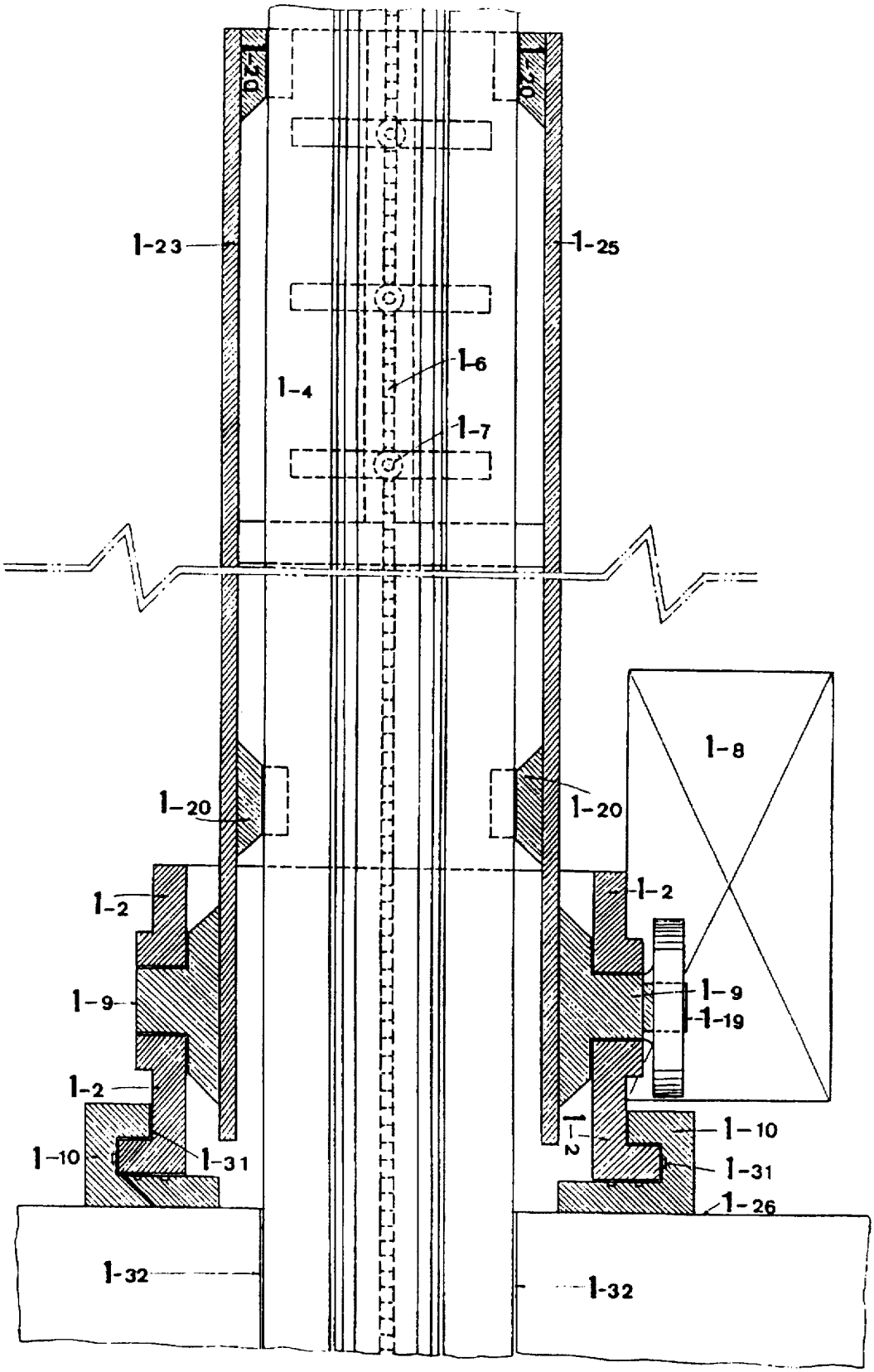
FIG. 13 is a cross-sectional view of the sliding box taken on line N—N shown in FIG. 11.
Figure 14:
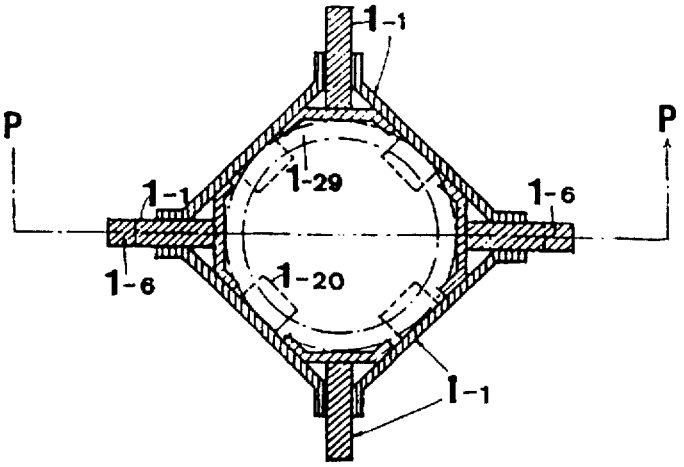
FIG. 14 is an enlarged lateral sectional view of the sliding box.

A pair of opposite guide rails 1-10 are installed in parallel on the deck 1-26 on the upper surface of each well 1-5. As shown in FIG. 9 and FIG. 13, a dovetail groove is formed on the opposite surface of the guide rails 1-10. A projected line externally being bent on the bottom surface of a sliding box 1-2 is coupled with the dovetail groove. As shown in FIG. 7 and FIG. 8, the sliding box 1-2 reciprocates back and forth in linkage with elongation and retraction of a cylinder rod 1-15 of an oil-pressurized cylinder 1-3 disposed on the deck 1-26.

Base structure of the sliding box 1-2 below a plurality of deformed-angular cylindrical oil-pressurized cylinders 1-4 is pivotally secured by means of a pair of pin shafts 1-9. As shown in FIG. 13, one of the pin shafts 1-9 is linked with a gear unit. As shown in FIG. 9 and FIG. 13, the gear unit is engaged with an inclining winch 1-8. The inclining winch 1-8 generates drive force to incline the steel rods 1-1 via a storage box 1-25. A pair of guides 1-20 for supporting the storage box 1-25 are engaged with the steel rod 1-1. When the pin shaft as 1-9 are rotated by the inclining winch 1-8, the steel rod 1-1 inclines itself together with the storage box 1-25.

When the tug lighter 1 floats upward on waves, the inclining winch 1-8 in the independently free position activates operation to cause the steel rod 1-1 to rise up itself in the obtuse-angled direction against water-bottom ground by making use of the underwater landed point as fulcrum. When the tug lighter 1 falls between waves, the steel rods 1-1 respectively incline themselves in the acute-angle direction against water-bottom ground to provide the tug lighter 1 with propelling force. The inclining winch 1-8 secures retention of the steel rods 1-1. As a result of initial operation and interlocking of a rack 1-6 and a pinion 1-7, synthetic force is thus formed in order that the steel rods 1-1 will incline themselves from the predetermined positional 70° towards 30° thenceforth. Inclined angle of the steel rods 1-1 is eventually fixed at 30° without making further incline. If the steel rods 1-1 were thrusted into water-bottom ground at an angle below 30°, retentive force of water-bottom ground cannot withstand pressure of the steel rods 1-1 to cause tips of the steel rods 1-1 to leave the water-bottom ground, and thus, this should be avoided.

The embodiment of the invention prevents tips of the steel rods 1-1 from sliding themselves by arranging that the steel rods 1-1 on respective steel-rod supporting members 1-21 will not incline themselves by more than 30°. When each steel rod 1-1 has actually inclined up to 30°, simultaneously, the rod 1-15 of the oil-pressurized cylinder 1-3 elongates itself to maximum range, and as a result, the sliding box 1-2 secured to the rod 1-15 arrives at the terminating point of forward movement. In succession, the rod 1-15 of the oil-pressurized cylinder 1-3 retracts itself to cause the pinion 1-7 to inversely rotate. In consequence, the steel rod 1-1 erects itself from 30° to 70°. When the steel rod 1-1 begins to return to 70° posture from 30°, support for the lower portion is lost. As a result, the inclining winch 1-8 activates own operation and then returns to original posture while maintaining as-of posture before eventually swinging itself.

Figure 11:
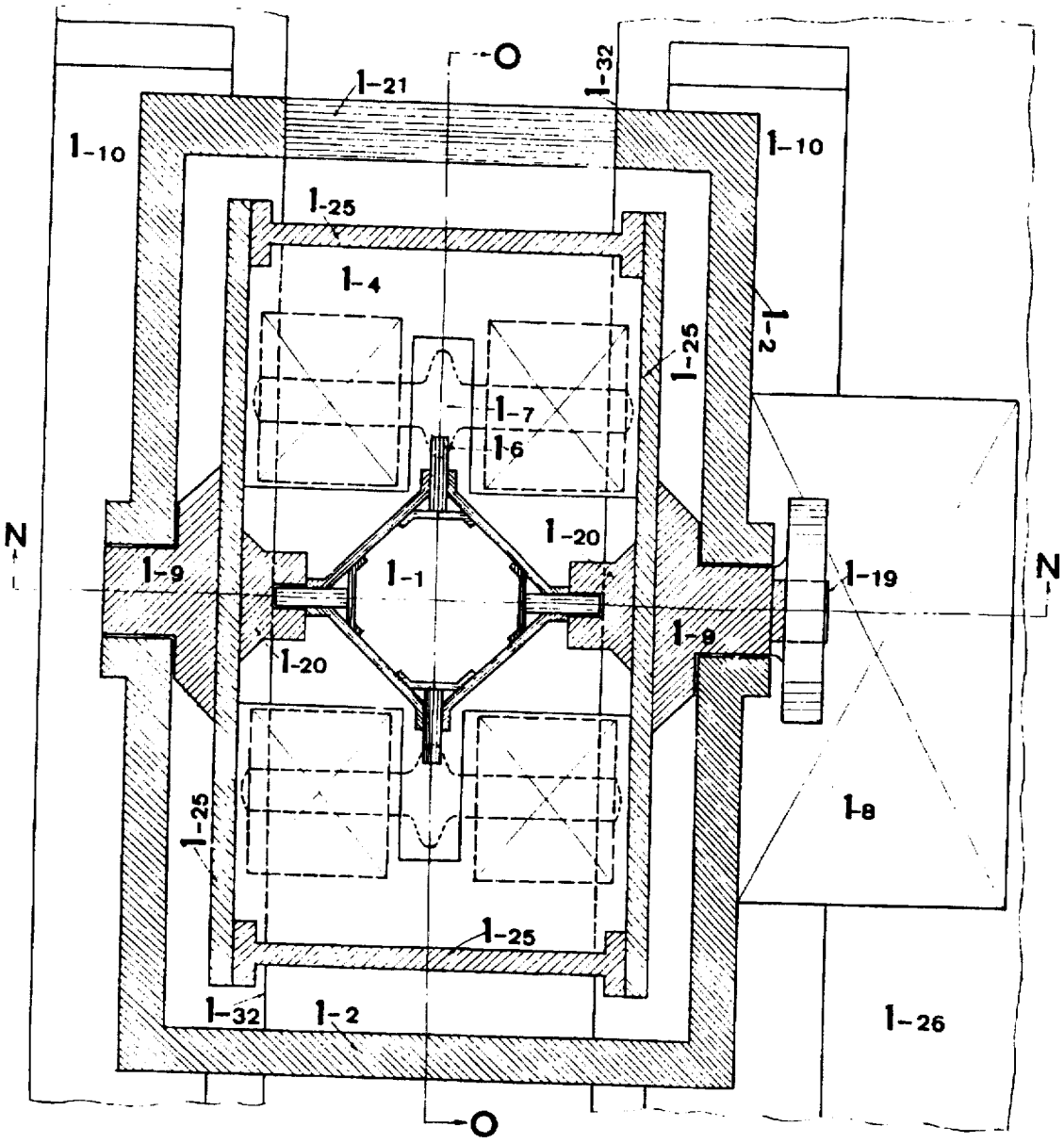
FIG. 11 is a sectional plan centering a sliding box.

As shown in FIG. 8, a pair of support guides 1-20 are projectively provided at the opposite upper and lower ends of internal surface of the oil-pressurized winch 1-4 through which the steel rod 1-1 penetrates. As shown in FIG. 11, grooves are formed on the opposite surface of the support guides 1-20. In addition, as shown in FIG. 8, a plurality of pinions 1-7 are disposed in the internal surface of the oil-pressurized winch 1-4 in the direction orthogonal to the support guides 1-20. As shown in FIG. 11, the steel rod 1-1 penetrating through the oil-pressurized winch 1-4 has projected lines engageable with the groove of each of the support guides 1-20. A pair of racks 1-6 respectively being engaged with the corresponding pinions 1-7 are provided in the direction orthogonal to the projected lines. By activating rotation of the pinions 1-7 engaged with the racks 1-6, the steel rod 1-1 ascends and descends.

Either a torque limiter (not shown) or a torque converter (not shown) is built in the gear shaft for driving the pinions 1-7 inside of the oil-pressurized winch 1-4. The torque limiter or converter buffers suddenly-attacking strong wave force to prevent the racks 1-6 and the pinions 1-7 from incurring damage.

As described above, the racks 1-6 and the pinions 1-7 are respectively engaged with each other. Although strong wave force can be buffered, considerable force is loaded on the racks and pinions 1-6 and 1-7 via impact of waves. To overcome this problem, substantial strength is required for the racks and pinions 1-6 and 1-7, and thus, these are designed to have proper dimension compatible with the required strength.

In order to properly design the racks 1-6 and the pinions 1-7, it is very important that long-term marine meteorological condition in specific locality be investigated very closely. A variety of natural conditions such as height of wave, period, tide current, wind velocity, and direction of wind, must also be taken into careful consideration.

It is practically impossible that mechanical strength of the racks and pinions 1-6 and 1-7 be secured to be fully compatible with all the natural environments. Provision of excessive strength for the racks and pinions 1-6 and 1-7 is by no means economical. Thus, it is essential to correctly identify maximum height of wave against which the racks and pinions 1-6 and 1-7 can actually withstand. In the event that marine meteorological condition is too hard beyond durable limit of the racks and pinions 1-6 and 1-7, in the same way as in the cancellation of sailing of conventional ships, underwater scraping operation should also be cancelled for the day to usefully make use of off-time for inspection and repair of equipment/tools.

When the racks 1-6 and the pinions 1-7 are interlocked, inclining of the steel rods 1-1 is initiated. As soon as the racks 1-6 and the pinions 1-7 are brought into engagement via another drive force, inclining of the steel rods 1-1 starts off. In this case, it is permissible to disconnect the inclining winch 1-8 via a clutch 1-19 and use both the racks 1-6 and the inclining winch 1-8 until the inclining angle becomes 70° through 30°. However, as was described above, at least two units of drive force are essential for activating incline of each of the steel rods 1-1.

Reciprocating movement of the sliding box 1-2 via operation of the oil-pressurized cylinder 1-3, swing movement of the steel rods 1-1 via operation of the inclining winch 1-8, and ascending/descending movement of the steel rods 1-1 via operation of the pinions 1-7, are simultaneously executed. Each steel rod 1-1 penetrating the oilpressurized winch 1-4 ascends and descends while swinging itself. Concretely, piecing member 1-28 at the bottom end of the steel rod 1-1 thrusts into water-bottom ground surface at 70° of erected posture. When the oil-pressurized winch 1-4 (through which the steel rod 1-1 penetrates) conjunctionally inclines based on the bottom end of the steel rod 1-1 functioning as fulcrum, as shown via broken lines in FIG. 3-A, based on the fulcrum function of the steel rod 1-1, the tug lighter 1 moves forward availing of drive force synthesized by force of the oil-pressurized cylinder 1-3 and force of the inclining winch 1-8 accommodating the inclined steel rod 1-1. FIG. 3-A illustrates the case in which three steel rods 1-1 thrust themselves into water bottom ground by −5 meters, −10 meters, and −15 meters. In the actual case, three of the steel rods 1-1 thrust into water bottom ground below the identical water depth.

As shown in FIG. 3-A, three of the steel rods 1-1 operate themselves in water as of the state being inclined by 30° through 70° in conjunction with each other. Accordingly, the tug lighter 1-1 continuously proceeds itself without intermittently making halt and advance. At least one of the three steel rods 1-1 always leaves the water-bottom ground 1-52 to lose support at the bottom end, and thus posture of the freed steel rod 1-1 remains unstable. Because of this, as soon as one of the three steel rods 1-1 has left the waterbottom ground 1-52, the inclining winch 1-8 instantly activates own operation to hold the rod 1-1 until reaching the next landing spot.

Figure 15:
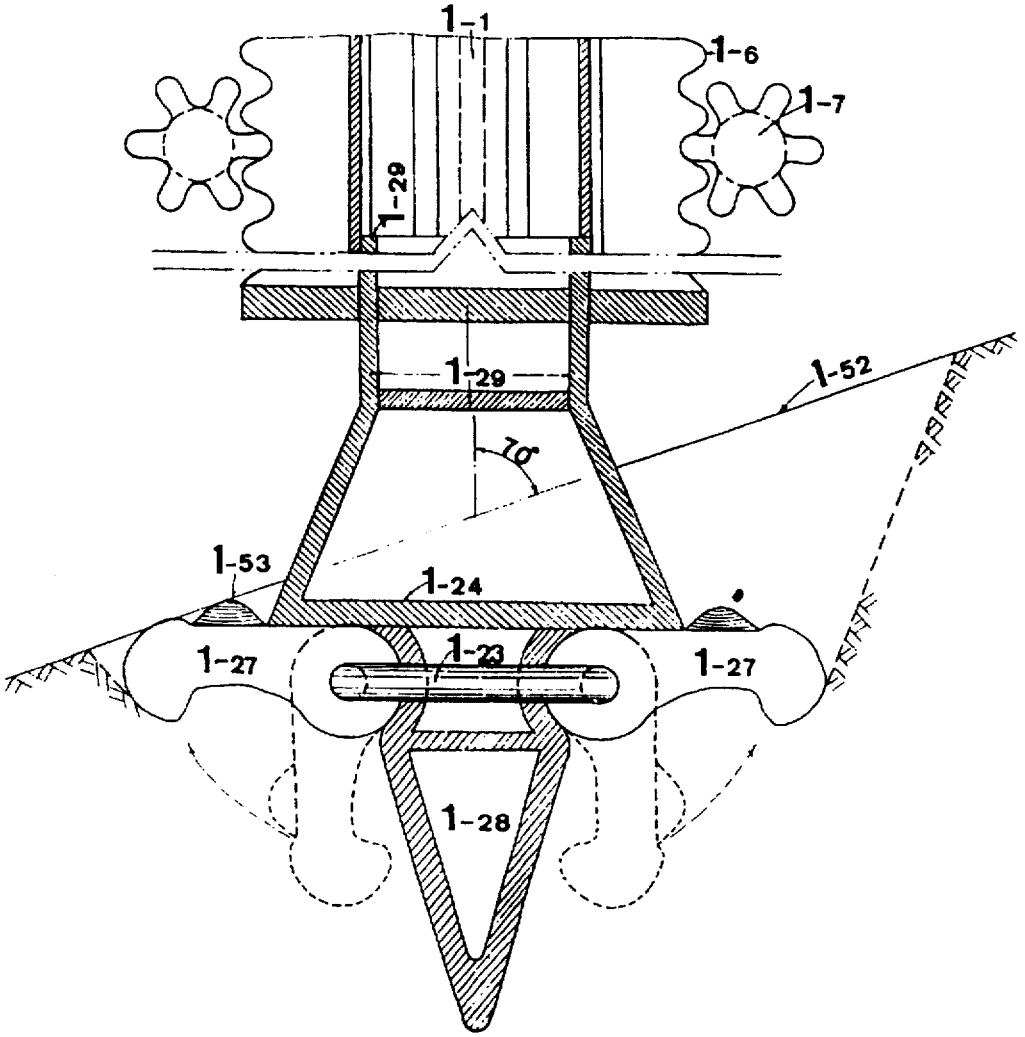
FIG. 15 is a cross-sectional view of the sliding box taken on line P—P shown in FIG. 14.

As shown in FIG. 15, a broad-width claw-presser 1-24 and a piecing member 1-28 projecting from the bottom surface of the clawpresser 1-24 are secured to the bottom end of the steel rod 1-1. The piecing member 1-28 is of tapered shape and has constricted juncture with the clawpresser 1-24, where the juncture member secures the base of a pair of claws 1-27 for generating force for supporting the steel rod 1-1 on the water-bottom ground. The supporting-force generating claws 1-27 are jointly secured by means of a round ring 1-23 and swingable in the horizontal and vertical directions. When being submerged, the supporting-force generating claws 1-27 are forcibly opened in the horizontal direction by means of floating force of a pair of plastic floats 1-53 to expand the landed area of the bottom member of the steel rod 1-1 and prevent the piecing member 1-28 at the bottom tip of the steel rod 1-1 from further sinking into the water-bottom ground. Owing to both effects, very strong force for supporting the steel rod 1-1 on the water-bottom ground is secured. Since the bottom tip member of the steel rod 1-1 thrusts into the water-bottom ground surface 1-52, the tug lighter 1 can be less affected by waves.

It is desired that vertical movement of the tug lighter 1 caused by waves be absorbed by elongation and retraction of the steel rods 1-1 by internally setting shock absorbers (not shown) in series in part of each steel rod 1-1. However, in this case, it should be considered very carefully not to lower strength of the steel rod 1-1 otherwise resulting in the occurrence of unwanted damage thereof.

As shown in FIG. 2-A and FIG. 3-A, a mast 1-46 is erected on the deck on the part of the tip of the shaft of the tug lighter 1. A sail 1-47 is set to the mast 1-46. Not only scraping earth and sand from water-bottom ground, but the tug lighter 1 also tugs the bucket conveyer 8, the belt-conveyer lighter 4, and earth and sand loaded on an earth carrier 5 under moorage. Accordingly, availing of wind force other than head wind, the tug lighter 1 gains propelling force via the hoisted sail 1-47.

The tug lighter 1 comprises the structure described above. Basically, two or three tug lighters 1 each having identical structure and identical operating capability are aligned in parallel. Arrangement of two tug lighters 1 aligned in parallel is exemplified below.

As shown in FIG. 23, a pair of tug lighters 1 are linked with each other by means of a mooring metal 1-33 across a fender 1-37 made from synthetic rubber. As shown in FIG. 6, a pair of tide-riding plates 1-43 obliquely oriented to enable the center portions to protrude themselves are respectively disposed on the part of the tip of the shaft of the tug lighter 1. The tide-riding plates 1-43 are used only when the tug lighters 1 can ride on tide current. If not, the tide-riding plates 1-43 are placed under storage. A plurality of compact oil-pressurized cylinders 1-3 having identical form are connected to the base end of each tide-riding plate 1-43. The tide riding plates 1-43 are shifted when the piston 1-14 and the rod 1-15 of the oil-pressurized cylinder 1-3 elongate and retract themselves.

An integral operation control cabin 1-39 is installed on the deck 1-26 on the part of the tip of the shaft of one of the tug lighters 1. The integral operation control cabin 1-39 controls operation of cylinders for swingably operating the oil-pressurized winch 1-4, operation of the inclining winch 1-8, up/down movement of each steel rod 1-1 penetrating the corresponding oil-pressurized winch 1-4, adjustment of scraping operation, adjustment of operating velocity of the bucket conveyer 3, a fin-attached belt 4-5, and a belt-conveyer 4-7 inside of earth/sand discharge base, surveillance of loading operation and display of water depth below respective equipment, positioning of the tide-riding plate 1-43 availing of tide current, hoisting of the sail 1-47 availing of wind velocity, fine directional turn, operation of the spuds 1-40 for inverting all the operating ships, computerized instruction to the earth carrier 5 for designating specific location for discharging earth and sand.

Actual height of waves is detected by sensors (not shown). If the height of waves exceeds a predetermined level, a control computer outputs instruction to discontinue driving of the steel rods 1-1, thus preventing the steel rods 1-1 and the racks and pinions from being damaged by up/down movement of the tug lighter 1 caused by wave force.

In order to execute the above control operations, sensors are set to important locations of the tug lighter 1. The captain and a plurality of crew operators in the integral operation control cabin 1-39 secure, watch, and judge actual operating conditions, and execute the predetermined operations via electrical remote control.

An oil-pressurizing/engine room 1-34 is provided below the deck 1-26 on the side of the stern of the tug lighter 1. An oil pressurizing tank, an oil pressurizing pump, a control valve, and a control panel, are installed in the oil-pressurizing section of the engine room. A compact-size auxiliary self-propulsion unit is installed in part of the engine room, which is solely used for moving the tug lighter 1 back astern.

According to common sense related to floating lighters, the belt-conveyer lighter 4 is connected to the stern of the tug lighter 1. The scraping device 2 and the bucket-conveyer 3 are disposed on the water-bottom ground between the tug lighter 1 and the belt-conveyer lighter 4. As shown in FIG. 2-A and FIG. 3-A, a pair of winches 1-48 are disposed on both sides of of the shaft of the tug lighter 1. As shown in FIG. 2-C, a pair of bollads 4-19 are disposed on both sides of the bow of the belt-conveyer lighter 4. The bollads 4-19 and the winches 1-48 are coupled with each other by means of coupling wires 1-36. The coupling wires 1-36 are attached with power supply cables (not shown), which are not connected to the scraper device 2 and the bucket conveyer 3.

As shown in FIG. 2-B, the scraper device 2 is suspended by a pair of welded chains 2-19 linked in the center of the tug lighter 1, a pair of coupling rods 4-29 connected to the bow sides of the belt-conveyer lighter 4 shown in FIG. 33-A, and a pair of suspension cables 4-3 and 3-4 (shown in FIG. 3-B and FIG. 33A-b) suspended from a pair of pulleys disposed at the top of a derrick crane 4-2 erected at the bow portion of the belt-conveyer lighter 4. Availing of operation of a powerful winch 4-4, the derrick crane 4-2 suspends the main scraper body 2-3 to initiate actual operation and properly adjusts scraping work.

Figure 17:
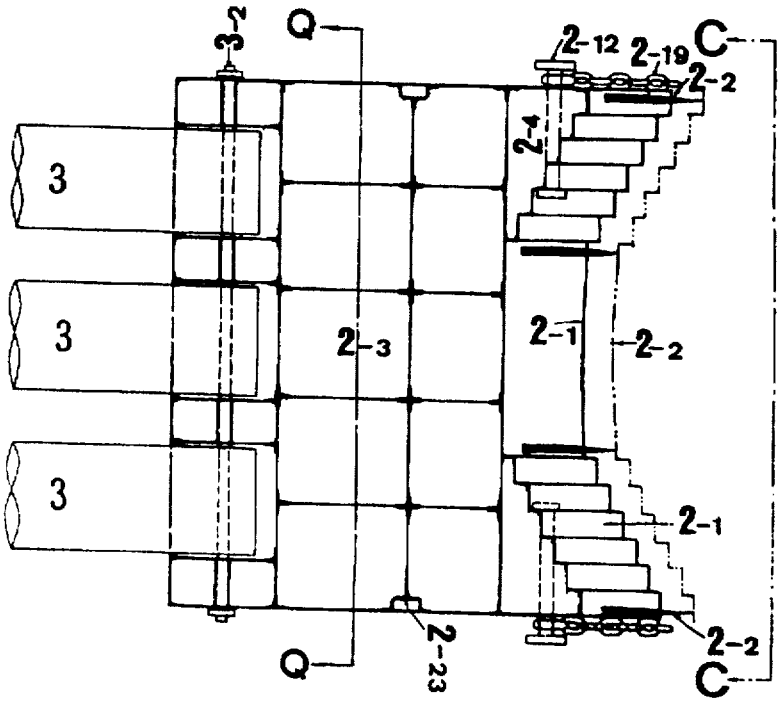
FIG. 17 is a plan of lower portion of the scraper device.
Figure 25:
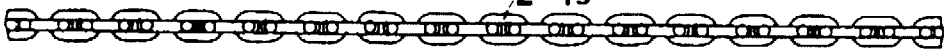
FIG. 25 is an enlarged plan of a welded chain.

As shown in FIG. 25, in order to withstand extremely strong force, the welded chains 2-19 for linking the scraper device 2 with the tug lighter 1 are completed by executing flashback welding. Both ends of each of the welded chains 2-19 are secured to a pair of fitting metals 2-12 secured to the foremost tip portion of the scraper device 2 as shown in FIG. 17 and a pair of fitting metals 2-12 secured to both sides at the tip portion of the second sliding box 1-2 ahead of the center portion of the tug lighter 1 shown in FIG. 2-A.

As shown in FIG. 33-B, both ends of the coupling rods 4-29 interlinking the scraper device 2 and the belt-conveyer lighter 4 are respectively structured to compose a pair of cross shafts 4-34 as shown in FIG. 33-B. Each of a pair of roller tubes 4-30 is axially supported by a corresponding stationary column 4-31. The stationary column 4-31 solidly secures the rear end of the scraper device 2 to the deck 4-27 at the tip of the belt-conveyer lighter 4. The scraper device 2 performs arc-forming movement by way of pivoting on a guide wheel 3-2 inside of the scraper device 2 at the tip of the bucket conveyer 3 and the shaft of a drive wheel 3-1 at the tip of the belt conveyer 4. It is arranged that, as shown in FIG. 33-Ab, the positions to fix the coupling rods 4-29 for interlinking the rear end of the scraper device 2 with the belt-conveyer lighter 4 onto the belt-conveyer lighter 4 correspond to the position in contact with the upper tip point of the belt-conveyer lighter 4 on the linear bisector T–T (4-33) interlinking the upper dead point and the lower dead point of the scraper device 2 performing arc-forming movement.

Not only for interlinking the scraper device 2 and the beltconveyer lighter 4, but owing to the formation of the cross-shafts 4-34 based on the coupling shafts 4-29, the coupling shafts 4-29 also minimize adverse influence from up/down movement of the bucket conveyer 3 caused by waves and from tide current or wind force.

Because of linkage between the tug lighter 1 and the belt-conveyer lighter 4 via the coupling wires 1-36, the tug lighter 1 is connected to the scraper device 2 in the state of slackening the welded chains 2-19. Since the welding chains 2-19 are held being slack, and yet, since the steel rods 1-1 are thrusted into water-bottom ground 1-52, the scraper device 2 is free from incurring adverse effect of waves. Scraping angle of the scraping device 2 is properly adjusted by means of a scraping-angle adjusting winch 1-35 shown in FIG. 2-A and FIG. 3-A.

The scraper device 2 comprises a main scraper body which is assembled with welded high-tension steel plates and tightly closed to secure generation of floating force and a replaceable blade 2-1 which is secured to tip portion of the main scraper device 2 and thrusts into water-bottom ground 2-13. The main body of the scraper 2 is tightly sealed so that floating force can be generated, and thus own weight is considerably reduced. Accordingly, the main scraper body 2 can easily be suspended as a result of the increased suspending force by means of a plurality of pulleys provided for the derrick crane 4-2.

The main scraper body 2 is structured to cause floating force to be generated. However, if the whole bottom surface of the main scraper body 2 were directly rubbed by the water-bottom ground, it will cause the bottom surface of the main scraper body 2 to be worn off very quickly and the abrasion resistance to increase. To prevent this, wear-preventive bases 2-16 are set to important spots on the bottom surface of the main scraper body 2. After passage through historical long ages, vast water bottom ground has substantially been levelled. However, there is no likelihood to promote scraping work by causing the water-bottom ground to be inclined upon contact with the bottom surface of the scraper device 2. Thus, there is neither excess nor shortage in the amount of earth and sand to be scraped. Although no obstacle can be generated by virtue of repeating fine adjustment of scraping operation, if the whole bottom surface of the main scraper body 2 were rubbed by the water-bottom ground, it will quickly promote wear,and yet, generate greater abrasion resistance. To prevent this, the whole bottom surface of the main scraper body 2 is protected from recklessly being rubbed by the water-bottom ground by virtue of the provision of the wear-preventive bases 2-16. Even though underwater condition is muddy, actual condition is constantly detected by underwater sensors to enable the computer to properly control all the adjustment operations.

Figure 18:
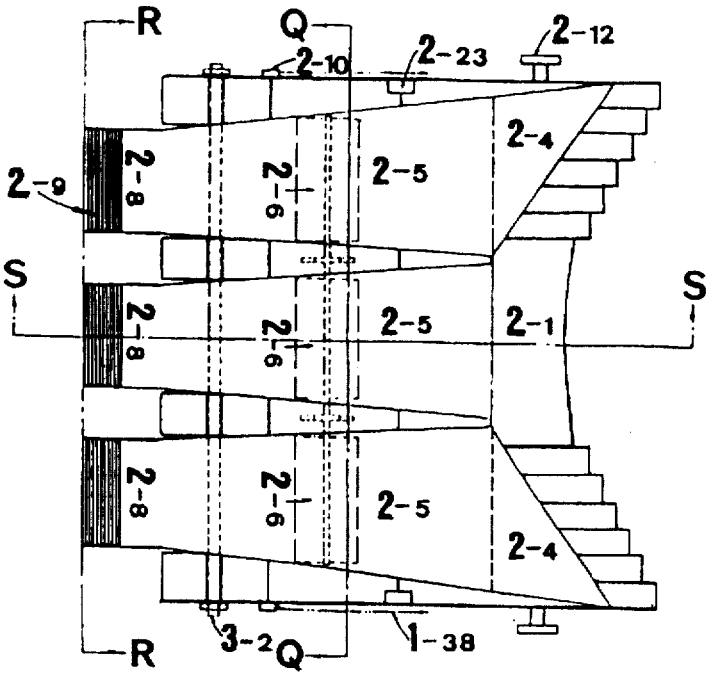
FIG. 18 is a plan of upper portion of the scraper device.
Figure 22:
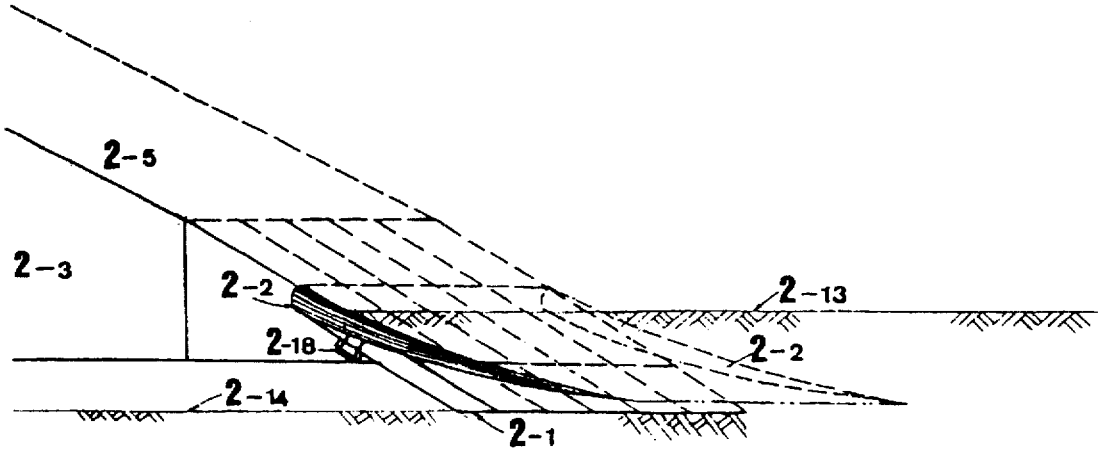
FIG. 22 is a lateral view centering replaceable blades.

The replaceable blade 2-1 and a pair of squarish plowers 2-2 are respectively made of super rigid steel, which are secured to the main scraper body 2 with built-in bolts or via welding as shown in FIG. 22. Most severely worn spots of the replaceable blade 2-1 and the squarish scrapers 2-2 are replaced whenever found necessary or periodically repaired via cutting with gas. As shown in FIG. 17 and FIG. 18, the center portion of the replaceable blade 2-1 is hollowed and the both sides thereof are protruded. As shown in FIG. 22, each replaceable blade 2-1 has a pair of projected horn-shaped scrapers 2-2 jointly thrusting into water-bottom ground (FIG. 17 deletes illustration of the horn-shaped scrapers 2-2). Using two of the hornshaped scrapers 2-2, water-bottom earth and sand solidified by hydropressure and fine earth particles are softened.

Figure 16:
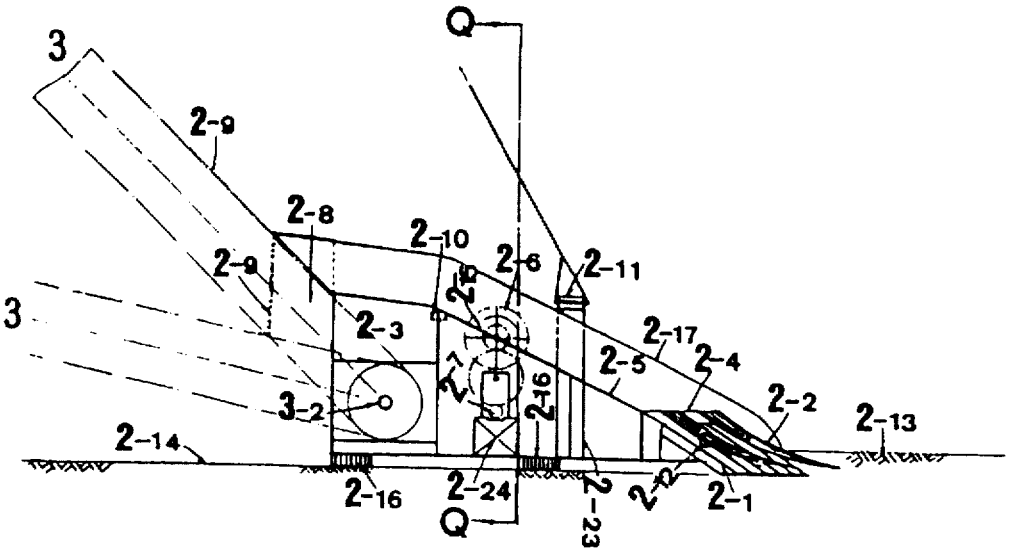
FIG. 16 is a lateral view of the scraper device.

As shown in FIG. 16, a pair of suspension-aid plates 2-23 for facilitating suspension of the main scraper body 2 are secured to lateral surfaces of the main scraper body 2. Eye plates 2-11 are set to the top of the suspension-aid plates 2-23 in order to hold one ends of the suspension wires 4-3.

As shown in FIGS. 16, 17, and 18, horizontal portion 2-4 is formed on the upper surface across both sides of the squarish scraper 2-2. The replaceable blades 2-1 on both sides thereof protrude themselves from those replaceable blades in the center, and thus, earth and sand scraped by the blades 2-1 on both sides are placed on these blades 2-1 earlier than those which are scraped by the blades 2-1 in the center. Then, earth and sand on both sides are lifted onto an earth/sand lifting base 2-5 together with those which were scraped by the replaceable blades 2-1 in the center.

Figure 21:
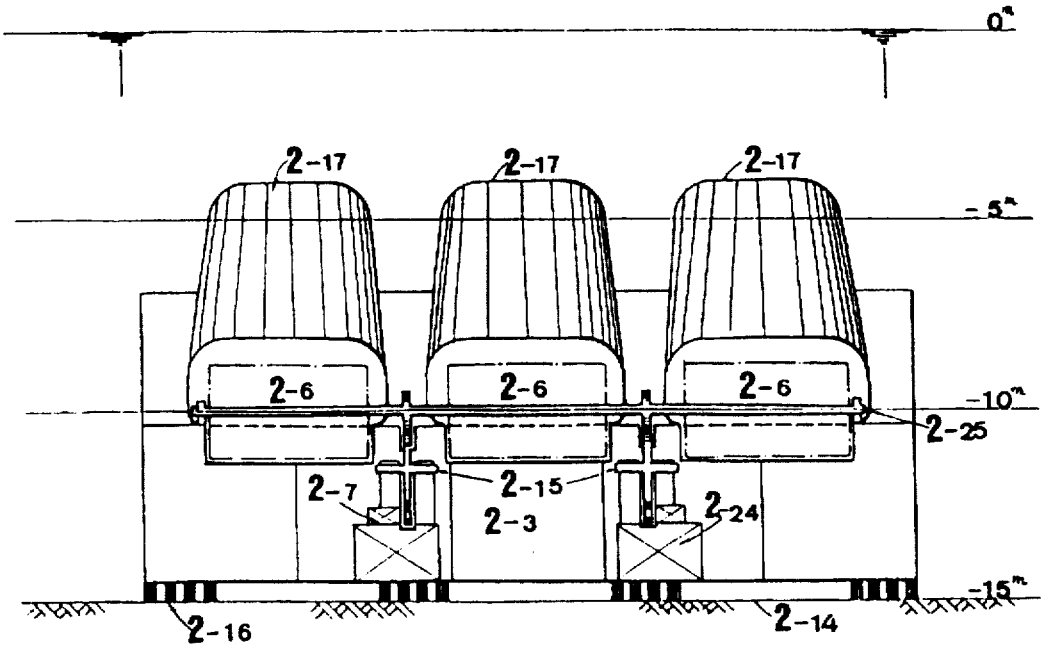
FIG. 21 is a cross-sectional view of the scraper device taken on line Q—Q shown in FIG. 16.

As shown in FIG. 16, the earth and sand lifting base 2-5 is of inclined posture in the manner of upwardly tilting itself from the base-end of the replaceable blades 2-1 to the rear end of the main scraper body 2. As shown in FIG. 18, the earth and sand lifting base 2-5 is longitudinally sectioned into three lines. As shown in FIG. 21, earth/sand covers 2-17 are respectively provided for the earth/sand lifting lines. Since the covers 2-17 respectively shield earth and sand from the exterior, earth and sand scraped from the water-bottom ground are upwardly conveyed from the front to the rear of respective lines of the lifting base 2-5 without scattering into water by earth and sand scraped in succession. Three passages are provided for the earth/sand lifting base 2-5 only for the sake of manufacture convenience and prevention of earth/sand conveying capacity from contraction in the event that width of the downstream-side conveyer is too wide. If it were schemed to carry an extremely large amount of earth and sand, it is of course practicable to provide four passages.

As shown in FIG. 16, FIG. 18, and FIG. 21, three of cross-form push-up plates 2-6 are disposed in the intermediate position of the earth and sand lifting base 2-5 in order that they can facilitate smooth lifting of earth and sand onto the earth/sand lifting base 2-5. The cross-form push-up plates 2-6 are arranged to be rotated slowly by a drive motor 2-7 and a transmission gear 2-15 disposed inside of the main scraper body 2.

An earth/sand drop-port 2-8 pronely formed by an L-shaped cover 2-9 (shown in FIG. 16) is provided at the rear end of the earth/sand lifting base 2-5. Earth and sand lifted through the lifting base 2-5 fall downward from the drop-port 2-8 without scattering into water. The bucket conveyer 3 shown in FIG. 1 and FIG. 2 is disposed between the bottom side of the drop-port 2-8 and the bow of the belt-conveyer lighter 4 in order that earth and sand scraped from water bottom can be conveyed to the belt-conveyer lighter 4 operating in atmosphere.

The bucket conveyer 3 conveys earth and sand from water bottom onto the following belt-conveyer lighter 4 floating on water surface. It is not necessary for the bucket conveyer 3 to scrape earth and sand and fix wires in all directions. Buckets 3-3 are respectively made of thin steel plate. Buckets 3-3 accommodating earth and sand are endlessly reciprocated between the scraping device 2 and the belt conveyer lighter 4.

Figure 27:
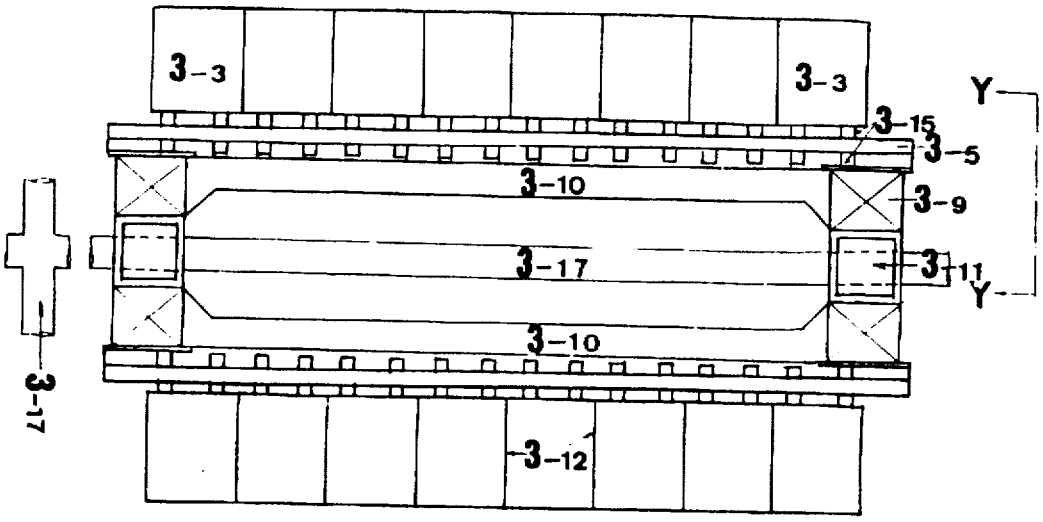
FIG. 27 is a cross-sectional view of the bucket conveyer taken on line X—X.

A number of bucket units are aligned in each bucket assembly 3-3 via space 3-13 (deleted in FIG. 27). As shown in FIG. 27, a pair of projected rods are provided below the bottom of each bucket unit. The buckets 3-3 are linked together by providing a bucket-supporting shaft 3-5 penetrating through them. The bucket-supporting shaft 3-5 bridges a pair of roller chains shown in FIG. 29. The roller chains are respectively engaged with teeth of a pair of sprockets 3-7 set to drive wheels 3-1 disposed on the belt-conveyer lighter 4 and guide wheels 3-2 disposed below the earth and sand drop-port 2-8.

As shown in FIG. 27, a plurality of longitudinal-directional vertical beams 3-9 built in framed-form at intervals of respective sprockets and width-directional horizontal beams 3-10 are disposed between the drive wheel 3-1 and the guide wheel 3-2. Both ends of the vertically arranged vertical beams 3-9 are linked with each other by means of a coupling member 3-11. As shown in FIG. 29, 6 units (3 pairs) of rails 3-8 are installed on the vertical beams 3-9. Six lines (3 units) of roller chains respectively slide on the 3 pairs of rails 3-8. These 3 units of roller chains compose 3 units of bucket conveyers which are integrated and framed by means of reinforcing members 3-17.

Figure 19:
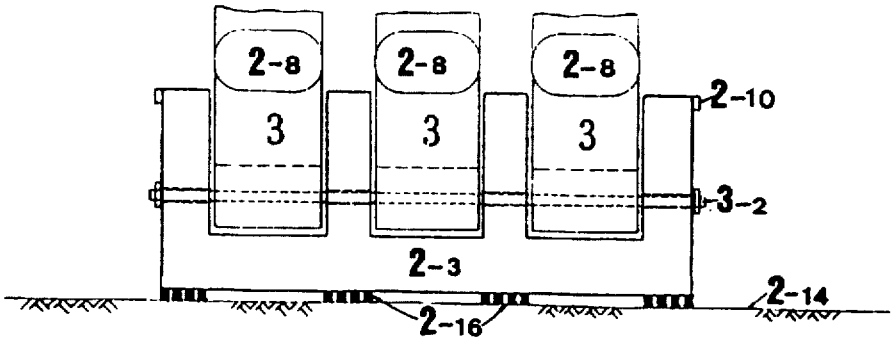
FIG. 19 is a back view of the scraper device.
Figure 20:
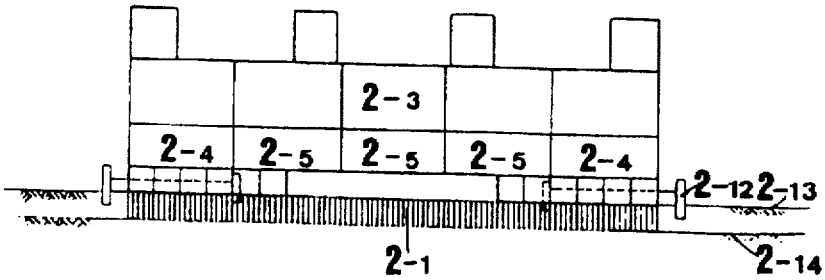
FIG. 20 is a lateral view of lower portion of the scraper device taken on line C—C shown in FIG. 17.
Figure 28:
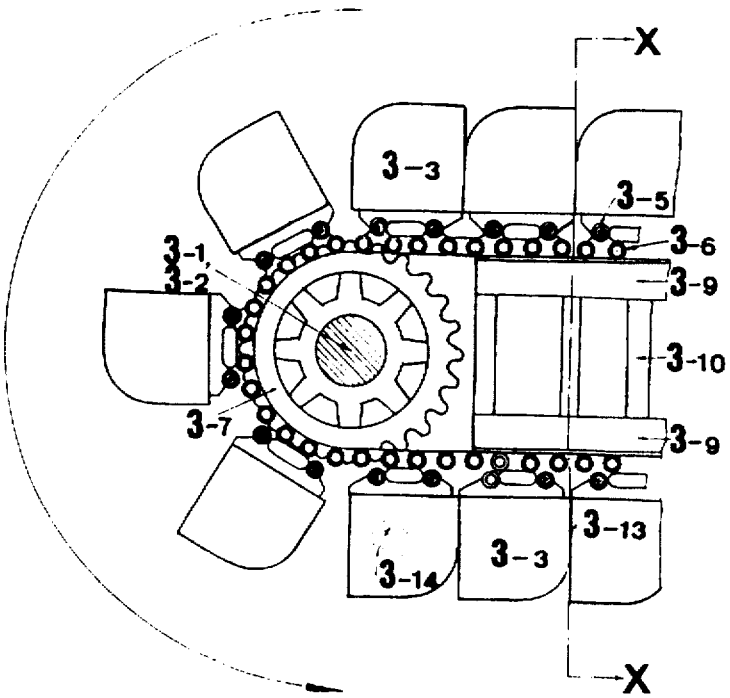
FIG. 28 is an enlarged lateral view of key components of the bucket conveyer.

In order to improve water discharge effect, as shown in FIG. 28, a number of fine holes 3-14 are formed through side plates 3-12 of the bucket unit. Narrow space 3-18 is formed between each bucket unit. Accordingly, water contained in scraped earth and sand can be discharged via fine holes 3-14 and narrow space 3-13 until earth and sand enter in a hopper 4-1 after atmospherically being exposed. As shown in FIG. 30, three lines of the buckets 3-3 are disposed in order that they can be continuous to the earth/sand lifting base 2-5. Width of each bucket 3-3 is slightly wider than that of the earth and sand drop-port 2-8. As shown in FIG. 19, earth and sand lifted onto the drop-port 2-8 are fully dropped into the buckets 3-3.

In order to dispose a common guide wheel 3-2 of the bucket conveyer 3 below the earth/sand drop-port 2-8 of the scraping device 2 making up/down movement, the bucket conveyer 3 is also swingable. To materialize this, in addition to a pair of suspension wires 4-3 for suspending the scraper device 2 from the peak of the derrick crane 4-2 disposed ahead of the belt-conveyer lighter 4, the other pair of suspension wires 3-4 are provided to hold tip portion of the bucket conveyer 3.

Since there is a certain limit in the length of the steel rods 1, since water depth needed for navigation route has been determined to be 15 meters, and yet, if the incline angle of the bucket body 3-3 exceeds 45°, since earth and sand drop off from the bucket body 3-3 to lower operating efficiency, length of the suspension wires 4-3 are restricted so that incline angle of the bucket conveyer 3 will not exceed 45° as shown in FIG. 3-Ab.

As shown in FIG. 3-B and FIG. 24-e, common drive wheels 3-1 of three units of the bucket conveyer 3 are mounted on a supporting bas 3-19 in conjunction with a pair of drive units 3-20 on both sides in the bow portion of the belt-conveyer lighter 4 mounting the derrick crane 4-2. The drive units 3-20 each having powerful drive force are provided in order to overcome substantially doubled weight of the bucket conveyers 3 accommodating earth and sand scraped from water-bottom ground because the bucket conveyers 3 lose floating force at the moment of emerging themselves from water surface. As shown in FIG. 2-C and FIG. 24-b, three units of floor hopper 4-1 are disposed in correspondence with three units of bucket conveyer 3. Upper portion of each floor hopper 4-1 is opposite from downstream end of the bucket conveyers 3 and forms an aperture for wholly accommodating earth and sand conveyed by the bucket conveyers 3.

As shown in FIG. 24, bottom of each floor hopper 4-1 is placed on a four-legged supporting base 4-28 sturdily fixed on the deck 4-27 of the belt-conveyer lighter 4. Each floor hopper 4-1 is supported in the oblique direction by a support member 4-26 so that no damage can be incurred to each floor hopper 4-1 even when being exposed to gravity generated by inflow of earth and sand and rolling effect caused by waves.

Intermediate portion of each floor hopper 4-1 consists of down-oriented hollow truncated quadrangular prism form. A disc-shaped water-absorbing panel 4-20 having a lid-provided fine 4-21 hole is secured to wall surfaces of each floor hopper 4-1. Bottom of each floor hopper 4-1 is of square tubular form so that earth and sand can securely fall onto a belt conveyer disposed therebelow. Four plates 4-35 each being supported by an angle are provided in the inwardly inclined manner in the lower external periphery of each floor hopper 4-1.

A water-absorbing booth pump 4-25 is mounted on each plate 4-35. Each water-absorbing panel 4-20 is connected to each water-absorbing booth pump 4-25 via a suction tube 4-23. A water-discharge tube 4-22 is extended from each water-absorbing booth pump 4-25 in order to forcibly discharge water. A pumping motor 4-24 is provided for each water-absorbing booth pump 4-25 disposed in four locations. Majority of water contained in earth and sand carried by the bucket conveyer 3 is discharged when atmospherically being exposed before earth and sand are poured into each floor hopper 4-1. However, some amount of water still remains in earth and sand. Since remaining water generates extra weight, remaining water is forcibly discharged by all the water-absorbing booth pumps 4-25 via discharge tubes 4-22.

As shown in FIG. 2-C and FIG. 3-B, upstream ends of belt-conveyers 4-5 provided in three lines are set below the floor hoppers 4-1. Downstream ends of the belt-conveyers 4-5 mounted on the discharge base 4-6 erected in the center portion of the belt-conveyer lighter 4 are lifted by approximately 15° of incline angle to cause earth and sand to be put onto a belt conveyer 4-7 set alongside the discharge base 4-6. As shown in FIG. 3-B, the discharge base 4-6 is built on the deck by iron columns. A sail is hosting over the discharge base 4-6.

As shown in FIG. 2-C, a sleeve structure having both wings protruding beyond width of the belt-conveyer lighter 4 is provided for the discharge base 4-6. As shown in FIG. 2-B and FIG. 26, the sleeve is disposed above two earth carriers 5 moored on both sides of the belt-conveyer lighter 4. Sensors are set to end surfaces of the sleeve, where the end surfaces are positioned above the center axes of the earth carriers 5. The sensors respectively detect actual amount of earth/sand loaded on the earth carriers 5. When earth and sand heap up, winches 4-11 are operated to intermittently shift the earth carriers 5.

Figure 26:
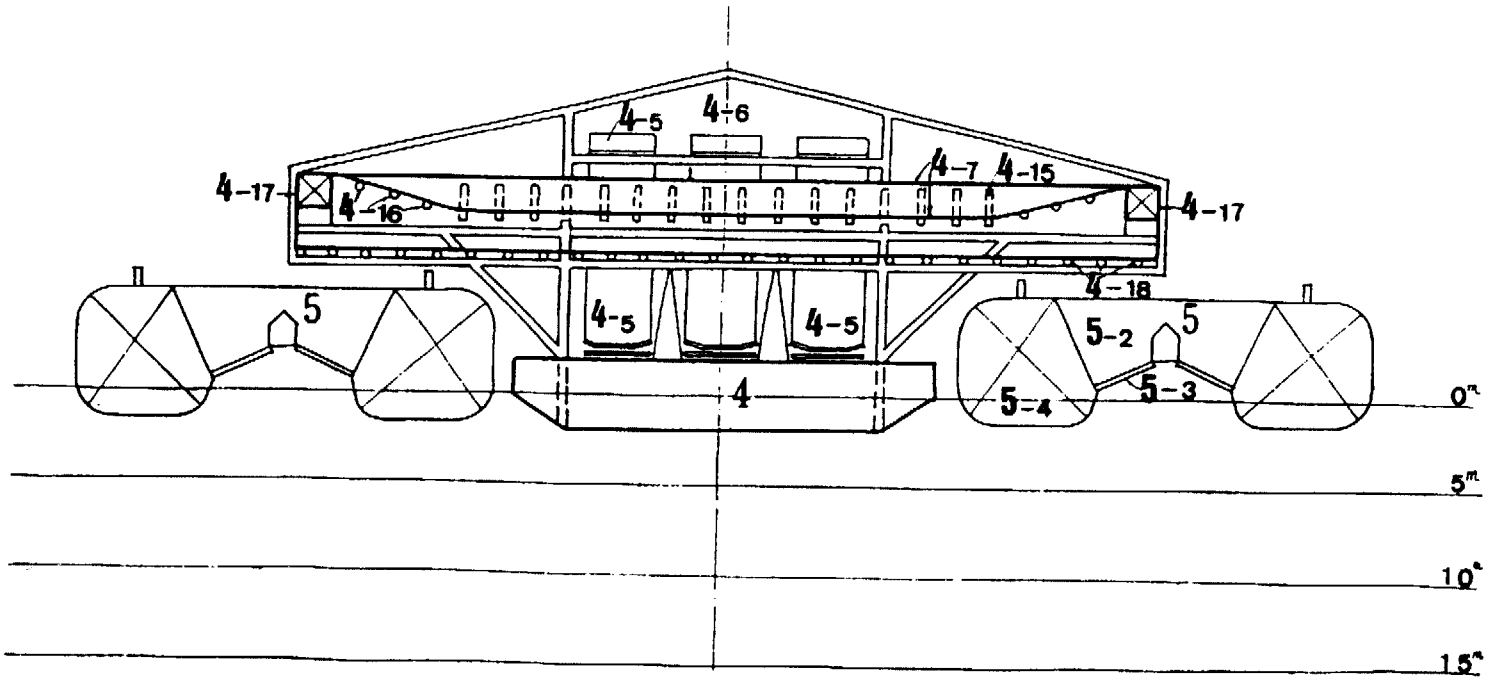
FIG. 26 is a cross-sectional view of the belt conveyer lighter taken on line D—D shown in FIG. 2C.

A belt 4-7 for conveying earth and sand in both directions is disposed inside of the discharge base 4-6. The belt 4-7 directly receives earth and sand from three belt conveyers 4-5. As shown in FIG. 3-B, center-axis side in the upper middle portion of the belt conveyer 4-7 is supported by rollers 4-15 in the manner being recessed in the V-shape. As shown in FIG. 26, as the belt runs closer to both ends, the belt conveyer 4-7 is levelled off by three converting rollers 4-16 which are disposed to become flat from mildly inclined angle. The belt conveyer 4-7 cycles itself by turning downward at both ends. The belt conveyer 4-7 in the lower route is supported by a number of support rollers 4-18 in the levelled manner. Winches 4-17 disposed at four corners of the discharge base 4-6 convert the running direction of the belt 4-7 between normal direction and inverse direction.

As shown in FIG. 2-B, a room 4-9 for storing parts and accommodating operators at rest, a repair shop 4-10, and a generator room 4-8, are provided on the part of the belt conveyer lighter 4. Replaceable parts are stored in the room 4-9 to save time for landing. Corner space is available for operators for accommodation and rest. Equipment can be repaired in the repair shop 4-10 along with operating routine. Since the whole operating facilities necessarily consume a very large amount of electric power, the generator room 4-8 is equipped with a gas-turbine generator being advantageous in terms of economy and operating efficiency, which also feeds electric power to the tug lighter 1 and submergible motors of the scraping device 2.

Taking balance of the whole of the belt-conveyer lighter 4 having a tremendous total weight into consideration, the coupling rods 4-29, the floor hopper 4-1, the derrick crane 4-2, the belt conveyers 4-7, the discharge base 4-6, the parts storage/operator's rest room 4-9, the repair shop 4-10, and the generator room 4-8, are properly disposed. In order to lighten draught of the belt-conveyer lighter 4, broad-width flat bilge is provided.

As shown in FIG. 2-C and FIG. 3-B, a pair of steel rods 4-32 usable for inversion are erected in the front and rear positions of the bow of the belt-conveyer lighter 4. Intermediate portion of each of the invertable steel rods 4-32 is pivotally supported on the deck 4-27 of the belt-conveyer lighter 4 by a pin shaft holding box 1-45 as shown in FIG. 31. The lower portion of the invertable steel rod 4-32 thrusting into water-bottom ground makes up a tip piecer 1-28 having a claw device 1-27 for generating force to support the lighter 4 on the water-bottom ground. Since the pin-shaft holding box 1-45 and the tip-piecer 1-28 exert function identical to that of the steel rods 1-1 of the tug lighter 1, description of the function of these components is deleted.

As shown in FIG. 3-B and FIG. 32, a tide-riding plate 1-43 is erected on the stern of the belt-conveyer lighter 4. As shown in FIG. 32-b, a pair of vertically aligned parallel racks 1-6 are provided for the tide-riding plate 1-43. An oil-pressurized winch 1-4 storing plural pinions 1-7 engageable with the racks 1-6 is mounted on the deck 4-27 of the belt-conveyer lighter 4. The pinions 1-7 are operated by the oil-pressurized winch 1-4. The tide-riding plate 1-43 is projected by the pinion 1-7 for use only when it can ride on tide current. The tide-riding plate 1-43 is stored while it cannot ride on tide current.

As shown in FIG. 2-C, a plurality of plane pulleys 4-14 are installed to both sides of the belt-conveyer lighter 4. An endless wire 4-12 and the other endless wire 4-13 are respectively set to the port-side plane pulley 4-14 and the starboard-side plane pulley 4-14. The endless wires 4-12 and 4-13 are rotated by electrical operation of the corresponding endless winches 4-11. As shown in FIG. 2-B, in order to moor the earth carriers 5 via plurality of moorages, a plurality of couplers 4-36 are connected to the endless wires 4-12 and 4-13.

As shown in FIG. 26, a hold 5-2 for storing earth and sand is provided in the center of each earth carrier 5. A ejecting door unit 5-3 for discharging earth and sand being capable of opening/closing themselves without submersion is set to the bottom of the hold 5-2. Air tanks 5-4 are disposed on both sides of the hold 5-2. When the earth carrier 5 is loaded with large volume of earth and sand, since draught of the earth carrier 5 is deepened, and yet, since other facilities are workable in such locations having more than 3 meters of water depth, it is arranged to prepare a number of compactly built earth carriers 5 each having plane bilge at standby position so that earth and sand can be loaded on serial carriers 5 one after another. As shown in FIG. 2-B, an easily handling pushing boat 5-1 is disposed to have the earth carrier 5 reciprocate between the earth dischargeable destination and the belt-conveyer lighter 4. In order to precisely detect the earth-dischargeable destination, electronic apparatuses utilizing an artificial satellite in space under instructions of a computer are mounted on each earth carrier 5.

When weather adversely varies while executing marine operation under rough condition, the tug lighter 1 is oriented so that it can face the windward, and then all the steel rods 1-1 are operated to thrust into water-bottom ground 1-52 at 70° of the maximum angle. The tug lighter 1 can prevent itself from incurring disaster by the above arrangement. Although the carry scraper ships related to the invention are mainly operated in an estuary, it is considered to be more appropriate to use the term "marine operation" in that the inventive ships jointly execute earth/sand scraping and transporting/discharging operations in such upstream locations at 60 through 100 killometers away from an estuary having more than 3 meters of water depth with inflow of high tide current.

Basically, navigating velocity of the tug lighter 1 is designed to be 1 meter per second because too fast navigation will cause earth and sand to scatter themselves when scraping operation is underway and the scraping operation will more effectively be executed when the tug lighter 1 navigates at a slower velocity and also because oil-pressurized operating force has mainly been introduced.

Actual dimension and operating capacity of the scraping device 2 are determined subsequent to estimation of mean outflow amount of earth and sand per annum based on the past results followed by estimation of the amount of earth and sand that should be scraped per second. Assume that mean global marine current velocity is approximately 1 meter per second and the width of the front surface of the inventive scraping device 2 to be 20 meters, then, the super-rigid replaceable blades 2-1 will scrape the water-bottom earth and sand by 14 cubic meters per second when thrusting into the water-bottom ground by 0.7 meter of depth. Then, assume that operators are workable based on three shifts and there will be some "off" days caused by rough weather and available for maintenance and repair work, the scraping device 2 will scrape approximately 300 million cubic meters of water-bottom earth and sand per annum.

Since navigating velocity of the "carry scraper ships" is much slower than other cruising vessels, in order to prevent other vessels from cruising themselves between the tug lighter 1 and the belt conveyer lighter 4, some cautionary floats (not shown) are provided between the tug lighter 1 and the belt conveyer lighter 4. These floats are respectively lit up with red warning light in the night. The warning is whistled from the integral operating room 1-39 to prevent unwanted collision from occurrence from behind.

Auxiliary parts are briefly described here in below. The reference numeral 1-11 shown in FIG. 8 designates a fixing plate for securing the oil-pressurized cylinder 1-3 to the deck 1-26 with a pin shaft 1-12. The reference numeral 1-16 designates a tube of the oil-pressurized cylinder 1-3. The reference numeral 1-17 designates a box-like coupling metal for coupling tip of a rod 1-15 with the sliding box 1-2. The reference numeral 1-18 designates a coupling pin shaft.

The reference numeral 1-21 shown in FIG. 7 and FIG. 11 designates a member for supporting the steel rods by forming recessed portion for supporting bottom surface of the steel rods 1-22 in part of the sliding box 1-2. The reference numeral 1-25 designates a box for storing the oil-pressurized winch 1-4.

The reference numeral 1-29 shown in FIG. 15 designates a connecting tube for connecting the bottom end of the steel rod 1-1 to the tip thereof.

Figure 12:
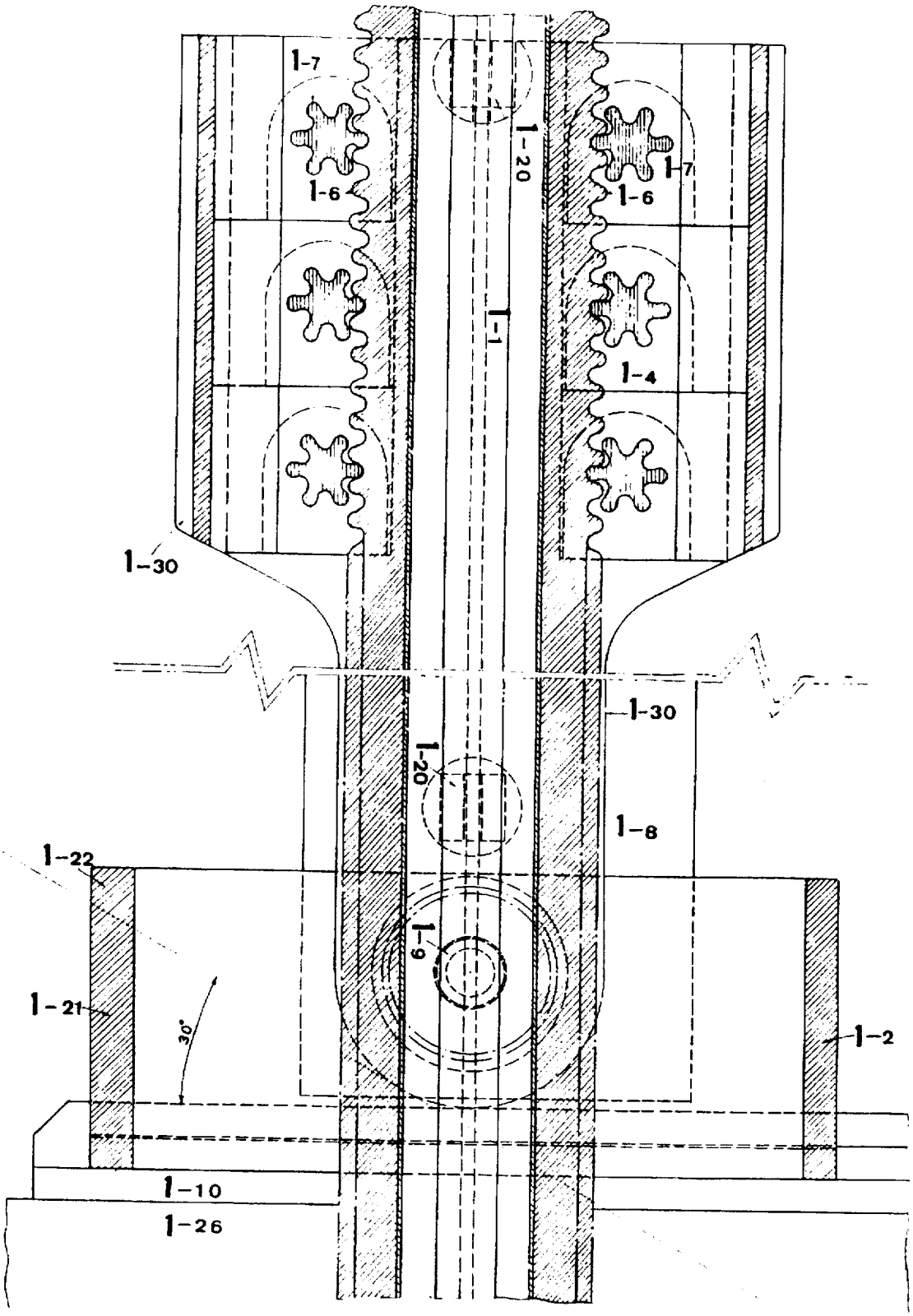
FIG. 12 is a cross-sectional view of the sliding box taken on line O—O shown in FIG. 11.

The reference numeral 1-30 shown in FIG. 12 designates a linking plate for linking the storage box 1-25 with the pin shaft 1-9.

The reference numeral 1-31 shown in FIG. 13 designates surface for inserting non-lubricating metal set to contact surface between the guide rails 1-10 and the sliding box 1-2 so that friction between them can be minimized.

The reference numeral 1-38 shown in FIG. 2-A and FIG. 3-A designates wires of the winches 1-35 for adjusting inclined angles of the steel rods 1-1.

The reference numeral 1-41 shown in FIG. 5 designates a compact oil-pressurized winch for lifting and lowering the spud 1-40. The reference numeral 1-42 shown in FIG. 5b and 5d designates a rotary shaft which inwardly drives the spud 1-40 and converts and turns the direction of the tug lighter 1 in the inverse direction. External periphery of the rotary shaft 1-42 rotates as of the inwardly driven state.

The reference numeral 1-44 shown in FIG. 6*a* designates a pair of cylinder-supporting plates for respectively supporting a compact cylinder 1-3 projecting outside of the tug lighter 1.

The reference numeral 1-49 shown in FIG. 5*a* and 5*b* designates a pair of supporting plates supporting the compact winch 1-41, where one of the supporting plates is secured to the deck 1-6 and the other is merely mounted on a plate 1-50.

The reference numeral 2-10 shown in FIG. 16 and FIG. 18 designates a scraping adjusting wire receptive metal of the scraping angle adjusting winch 1-35.

The reference numeral 2-14 shown in FIG. 16 designates ground surface after scraping water-bottom ground 2-13.

The reference numeral 2-15 shown in FIG. 21 designates a power transmission gear transmitting drive force of the drive motor 2-7 to the cross-form push-up plate shaft 2-25.

The reference numeral 2-20 shown in FIG. 2-C designates a pair of suspension winches set to the bow of the belt-conveyer lighter 4. The reference numeral 2-21 designates a pair of guide pulleys.

The reference numeral 2-22 shown in FIG. 33-Bc, Bd, Be, and Bf designates a column for fixing the roller shaft 4-34 on the part of the scraper device 2 against the fixing column 4-34 of the belt conveyer lighter 4.

The reference numeral 2-24 shown in FIG. 16 designates a base for supporting the motor 2-7.

The reference numeral 3-6 shown in FIG. 28 and FIG. 29 designates a plurality of roller chain shafts.

The reference numeral 3-15 shown in FIG. 27 and FIG. 29 designates a plurality of bucket supporting plates.

The reference numeral 3-17 shown in FIG. 27 and FIG. 30 designates a vertical and horizontal directional reinforcing frame structure for holding whole of the bucket conveyer 3.

The reference numeral 3-16 shown in FIG. 29 designates a pair of stopper metals.

The reference numeral 3-18 shown in FIG. 29 designates a pair of rollers.

The "carry scraper ships" according to the invention comprises the structure described above. Next, the method of removing earth and sand from the water-bottom ground is described below.

In the preparatory stage, plans are made in detail. Concretely, presence of the old sea bottom is confirmed at the farthest offing of the sedimentary area, and then, water channel is plowed by 200 meters of minimum width and 5 meters of depth from the suddenly deepened spot of the sea towards estuary during a single dry season. When rainy season is entered, horizontal and vertical directional erosion is enticed to cause erosion to expand via natural force to generate flow of earth. After completing the work for scraping the predetermined water channel up to estuary, when dry season is entered, another water channel is plowed out from upstream side towards estuary. A plan is set in order to expand the water channel at a stretch via natural force and by operating the "carry scraper ships". Thenceforth, navigating route is circularly formed.

After making the concrete plan described above, at the beginning of executing the planning work, the scraping-angle adjusting winch 1-35 is operated, and then, using the erected replaceable blade 2-1, the scraping device 2 suspended by the derrick crane 4-2 is lowered onto water-bottom ground. As a result, because of own weight of the scraper device 2, tip ends of the squarish scraper 2-2 and the replaceable blade 2-1 slightly thrust into water-bottom ground 1-52 to cause the tug lighter 1 to move forward. In response, scraping operation is compulsorily initiated. Earth and sand scraped off from water-bottom ground at both ends of the replaceable blade 2-1 pass through the horizontal portion 2-4 in the manner preceding other portions, and then scraped earth and sand are jointly pushed upward onto three earth/sand lifting bases 2-5 before being lifted backwards as of the state being shielded by the three covers 2-9.

The cross-form push-up plates 2-6 keep on rotating themselves at a slow speed at the rear-upper position of the earth/sand lifting bases 2-5. Being aided by the rotation of the cross-form push-up plates 2-6, earth and sand upwardly move on the earth/sand lifting bases 2-5, and finally fall onto the rotating bucket body 3-3 from the uppermost earth/sand drop ports 2-8. Earth and sand stored in the bucket body 3-3 then fall onto the hoppers 4-1 at the tip of the belt-conveyer lighter 4, and then, earth and sand are conveyed in the longitudinal direction via three-line fin-attached belts 4-5.

The belt conveyers 4-7 endlessly convey earth and sand in the single direction. After receiving earth sand sand from the fin-attached belts 4-5 aligned in three lines, the belt conveyers 4-7 carry the loaded earth and sand onto one of the earth carriers 5 moored along the belt-conveyer lighter 4. After completing the loading of earth and sand on this earth carrier 5, in response to the instructions of the integral operation control room 1-39, the earth carrier 5 proceeds to the predetermined earth-discharge location for reclaiming new land. Simultaneously, conveying direction of the belt conveyers 4-7 is inverted by the winches 4-17 installed in four corners of the discharge base 4-6 in order that the belt conveyers 4-7 can convey earth and sand onto the other earth carrier 5 moored on the opposite side of the belt-conveyer lighter 4. Accordingly, earth and sand are continuously loaded on the earth carriers 5. Based on the instructions transmitted from the integral operation control room 1-39, all the earth carriers 5 transport earth and sand via the shortest distance. It is also important to effectively place the earth carriers 5.

Not only navigating through linear route, but the carry scraper ships also needs to slightly invert the route even in a wide bay. Furthermore in order to avoid flow of adverse tide current caused by rise and fall of the tide occurring every six hours, the carry scraper ships must compulsorily invert own navigating route.

When inverting the navigating route, initially, earth scraping operation is laid off before departure of the earth carrier 5. In the meanwhile, the other earth carrier 5 on the other side of the belt-conveyer lighter 4 is sidetracked. Concretely, scraping work is discontinued only after fully loading earth and sand on the departing earth carrier 5. The other earth carrier 5 is sidetracked as of empty hull. Next, the scraper device 2 and the bucket conveyer 3 are slightly lifted from water-bottom ground so that the scraping device 2 will not be dragged on the water-bottom ground, and then the spuds 1-40 at the stern of the tug lighter 1 are thrusted into water-bottom ground, and then, the steel rods 1-1 are lifted from the water-bottom ground. Next, as shown in FIG. 31, one of the two steel rods 4-32 erected on the stern of the belt-conveyer lighter 4 starts to incline itself. When this steel rod 4-32 has inclined by 45°, the other steel rod 4-32 activates operation. After being inclined up to 30°, both of the steel rods 1-1 leave the water-bottom ground and return to original posture. The steel rods 1-1 alternately repeat the above functional movement in sequence.

On the part of the tug lighter 1, of those steel rods 1-1 set in four ranks in the widthwise direction, only the steel rods 1-1 in a rank capable of turning themselves in the same direction either to the left or to the right are operated. Of the three steel rods 1-1 in each rank, the one having the first serial number is initially operated, and then those which having the second and third serial numbers are sequentially operated.

As a result, as shown in FIG. 4 and FIG. 31, centering around the spuds 1-40, the tug lighter 1 turns itself in the direction identical to the turning direction of the belt-conveyer lighter 4 at the position of making a turn. After simultaneously completing inversion of the tug lighter 1 and the belt-conveyer lighter 4 as of the state of suspending the scraping device 2 and the bucket conveyer 3, both of the earth carriers 5 are brought back to both sides of the belt conveyer lighter 4. Finally, the whole operating routines are resumed by setting the scraping device 2 and the bucket conveyer 3 in position.

Although inversion of the tug lighter 1 and the belt-conveyer lighter 4 can also be materialized by operating a pair of tug boats, joint navigation accompanied by tug boats is not only troublesome, but it also takes much time to execute inverting operation, and yet, it will bother other navigating ships, and thus, it is desired that inversion be effected via the method described above without the aid of tug boats.

The earth carrier 5 loaded with earth and sand then arrives at the predetermined destination specified by the design plan availing of an artificial satellite in space as per instructions of computer. Upon arrival at the destination, the earth carrier 5 opens up the earth discharge doors 5-3 to unload earth and sand to recover proper floating condition. After closing the earth discharge doors 5-3, the earth carrier 5 returns to the alongside of the belt-conveyer lighter 4 in order to fully load earth and sand over again.

Along with the earth scraping operation, shore-protection work is also executed in the periphery of land reclaimable area by applying dumped earth. Shore protection work can be materialized by heaping up a number of tetrapods as temporary means. Since tetrapods are not permanent means for implementing shore protection work, perfect shore protection effect is achieved by applying a method of building simple and compact quay or by structuring embankment.

Caisson can be installed to a berthing site. However, it is preferred that the "Method of structuring quay in earth/sand accumulated area in estuary of huge river" according to the previous application for the Japanese Patent effected by the Applicant of the present invention as per the Japanese Laid-Open Patent Publication No. Hei-1-287308 of 1989 and the art based on "Marine quay" (Registered No. 24443) bearing the content identical to said inventive method and having been granted for the Chinese Patent in the People's Republic of China on the 19th Sep. 1993, be utilized. According to the inventive method of structuring quay, reinforced concrete piles are driven into water-bottom ground by apile-driving ship, and then, cellular blocks are accumulated above the high-tide sea level, which are then filled with stone-mixed submersible concrete, and finally, back-side embankment is completed with earth and sand. The novel quay according to the above patented art can be fully protected from erosion caused by waves, and yet, the novel quay can be dispensed with damage from earthquake such as liquidization as another advantageous feature.

By implementing preliminary boring, actual location of sand and pebbles for composing bone of quality concrete is investigated in advance. Sand and pebbles are collected by operating the inventive carry scraper ships. Initially reclaimed new land is utilized to build a concrete manufacturing factory. In other words, instead of transporting concrete product to the newly reclaimed land after manufacturing it at a certain concrete manufacturing factory on an existing land, concrete products usable in the newly reclaimed land are totally manufactured therein.

A large number of tetrapods are manufactured even when strength is slightly insufficient in that primary object is to increase gross weight of tetrapods by way of increasing amount of cement in the case if collected earth and sand had too fine particles being ineffective for composing concrete. If collected earth and sand are of satisfactory quality, water is fed from upstream side of river via pipes in order to wash off salt. Using salt-free earth and sand, cellular blocks and piles are manufactured from reinforced concrete for the river-side protection.

According to the invention, those advantages can be achieved. Concretely, the inventive carry scraper ships can respectively enable the tug lighter to tow all the facilities and exert mobility by way of effectively navigating without loss, and yet, since they can effectively utilize natural force, fuel consumption can be saved.

According to the invention, since the number of steel rods can be adjusted in response to the demand for the predetermined amount of transferable earth and sand, the whole operating facilities can be mechanized and operated by a small number of operators based on three shifts, and yet, since several operating fleets can be formed, the inventive carry scraper ships can effectively deal with transfer of an extremely huge amount of earth and sand. In other words, the inventive carry scraper ships are suited for creating the above-mentioned water channel.

Accordingly, the inventive carry scraper ships can transfer the predetermined large amount of earth and sand in a very short period of time by way of significantly surpassing normal capability of any conventional earth-scraping lighters. In consequence, since the inventive carry scraper ships can finish up the planning work during dry season, there is no fear of reducing all into naught. It is taken into consideration that relative to the lowered river bed in the estuary, the upstream-side river bed is induced to follow natural descent, and thus, the amount of the descended earth is also taken into account.

After plowing water channel by operating the inventive carry scraper ships, new land is reclaimed by utilizing them.

Concretely, water channel is formed by executing the processes described above, and then, independent of dry season and rainiy season, based on the preliminarily investigated data and reclaiming design plan, the largest majority of wind direction and wave direction are selected, and finally, construction is executed to form quay as per the method of forming quay based on the purpose of preventing erosion caused by attack of waves. The schemed quay shall have L-shaped plane and 80 through 100 meters of length. Land is sequentially formed from the inside portion where the quay is not formed. Angular portion for materializing the L-shaped quay is set on the windward part so that reclaimed land will not be washed off by waves.

After fully building up new land up to a predetermined height from the water level, bulldozers are carried onto the new land to vertically solidify and level off the land and then pressurize it with blades of an earth shifting ship sideways. In this way, new land is completed to enable construction of a concrete manufacturing factory thereon.

Thenceforth, based on the scheme, removal of earth/sand accumulated on water-bottom ground for further expansion of 200-meter wide navigation route on demand and construction of new land are continuously executed. Concretely, new land in growing demand is reclaimed inside of bay in order that collection of huge public investment disbursed for the river conservation work can be expedited.

Practically, the "carry scraper ships" according to the invention is not suited for dealing with such water-bottom ground consisting of rigid base rock or bluish clay stratum. However, even in the case of these soil compositions, the inventive "carry scraper ships" can fully exert substantial capability in dealing with vastly soil accumulated area in any of those huge rivers in which very thick soil accumulated stratum has been formed with continuous flow of a large amount of earth and sand from upstream side lasting to the present.

No obstruction can be incurred to navigation of other ships in the river or bay in which the inventive "carry scraper ships" are engaged in the soil scraping/transporting operation.

Furthermore, according to the utility of the inventive "carry scraper ships", newly reclaimed land in high demand can be created in a large city, and yet, invested money can be collected very quickly. The newly created land can be utilized instantly before consummation of the whole construction works.

After completion of the whole dredging work, water-bottom ground is levelled off to dispense with additional levelling work. Even when a harbor fails to properly function itself, defect will be removed very soon via useful operation of the inventive facilities, and then the harbor will restore normal condition. Even though accumulation of earth and sand in rivers expands to offing, in order to lower river bed level up to upstream side, the inventive "carry scraper ships" are effectively operated to lead to overall control of rivers, thus making it possible to elongate navigating distance of large-size vessels.

What is claimed is:

1. A carry scraper ship comprising:

a device for scraping and lifting earth and sand accumulated on ground under water;

a tug lighter having means thereon for bearing against ground under water to thereby advance the tug lighter and tow the device for scraping and lifting, said bearing means comprising an elongate element with a length and a drive mechanism for angularly reorienting the length of the elongate element relative to the tug lighter both with and without the bearing means bearing against ground;

a bucket conveyor for conveying earth and sand scraped and lifted from ground under water to an atmospheric environment above water;

a belt conveyor lighter for discharging earth and sand conveyed from under water to the atmospheric environment onto earth carriers; and means for linking the tug lighter, the device for scraping and lifting, the bucket conveyor, and the belt conveyor lighter together in operative relationship.

2. The carry scraper ship according to claim 1 wherein bearing means comprises a plurality of steel rods on the tug lighter which can swing relative to the tug lighter while making ascending and descending movements.

3. The carry scraper ship according to claim 2 wherein rack gears are provided for each of the steel rods, said rack gears being connected to a tubular oil-pressurized winch which swings the steel rods relative to the tug lighter, the oil-pressurized winch is connected to a sliding box, and the sliding box is connected to an oil-pressurized cylinder.

4. The carry scraper ship according to claim 1 wherein the device for scraping and lifting has a front and rear, and there is a squared scraper projecting from the front of the device for scraping and lifting for thrusting into ground under water.

5. The carry scraper ship according to claim 1 where the device for scraping and lifting has a front and rear, and there are earth/sand lifting bases on the device for scraping and lifting each angularly inclined from front to rear of the device for scraping and lifting.

6. The carry scraper ship according to claim 5 including fixed covers for each of the earth/sand lifting bases.

7. The carry scraper ship according to claim 5 wherein the belt conveyor lighter has a bow, the bucket conveyor has an upstream end and a downstream end and the upstream end of the bucket conveyor is disposed below the rear ends of the earth/sand lifting bases and the downstream end of the bucket conveyor is disposed at the bow of the belt conveyor lighter.

8. The carry scraper ship according to claim 1 wherein the bucket conveyor has plates with a plurality of holes therein to allow water contained in earth/sand on the bucket conveyor to drain therethrough.

9. The carry scraper ship according to claim 1 including a hopper in which earth/sand are loaded to forcibly discharge water therethrough before loading of earth/sand onto the belt conveyor lighter.

10. The carry scraper ship according to claim 1 wherein the belt conveyor lighter has a front and rear and a lateral dimension and there are sleeves on the belt conveyor lighter projecting laterally from the belt conveyor lighter.

11. A carry scraper ship comprising:

a tug lighter having steel rods thereon that can be raised and lowered and swung relative to the tug lighter, there being an oil-pressurized winch to which the steel rods are connected, said oil-pressurized winch set on a box that is slidable relative to the tug lighter, with there being an oil-pressurized cylinder operatively connected to the box;

a device for scraping and lifting earth and sand accumulated on ground under water;

a bucket conveyor separate from the device for scraping and lifting for conveying earth and sand scraped and lifted from ground under water to an atmospheric environment above water;

a belt conveyor lighter separate from the device for scraping and lifting for discharging earth and sand conveyed from under water to the atmospheric environment onto earth carriers; and means for linking the tug lighter, the device for scraping and lifting, the bucket conveyor, and the belt conveyor lighter together in operative relationship.

12. A carry scraper ship comprising:

a tug lighter for towing;

a device for scraping and lifting earth and sand accumulated on ground under water, said device for scraping and lifting having a front and rear and a replaceable blade at the front of the device for scraping and lifting having a squared scraper to engage ground under water, said device for scraping and lifting further having lifting bases inclined from front to rear and covers for the lifting bases;

a bucket conveyor separate from the device for scraping and lifting for receiving from the device for scraping and lifting earth and sand scraped and lifted from ground under water by the device for scraping and lifting and conveying earth and sand scraped and lifted from ground under water to an atmospheric environment above water;

a belt conveyor lighter for discharging earth and sand conveyed from under water to the atmospheric environment onto earth carriers; and means for linking the tug lighter, the device for scraping and lifting, the bucket conveyor, and the belt conveyor lighter together in operative relationship.

13. A carry scraper ship comprising:

a tug lighter having steel rods that can ascend and descend relative to the tug lighter and are operatively connected to an oil-pressurized winch that is in turn connected to a sliding box operatively connected to an oil-pressurized cylinder;

a device for scraping and lifting earth and sand accumulated on ground under water, said device for scraping and lifting having a front and rear and lifting bases that incline between the front and rear of the device for scraping and lifting, there further being covers each with spaced openings for the lifting bases so that earth and sand being lifted by the lifting bases passes into one of the spaced openings to and out of the other of the spaced openings in the covers and is substantially covered between the openings in each of the covers;

a bucket conveyor for conveying earth and sand scraped and lifted from ground under water to an atmospheric environment above water; and a belt conveyor lighter for discharging earth and sand conveyed from under water to the atmospheric environment onto earth carriers.

14. The carry scraper ship according to claim 1 wherein the device for scraping and lifting is separate from the bucket conveyor and lifts and thereafter transfers earth and sand from ground under water to the bucket conveyor.

15. The carry scraper ship according to claim 1 wherein the tug lighter and belt conveyor lighter are floatable independently of each other in a body of water supporting the tug lighter and belt conveyor lighter.

16. The carry scraper ship according to claim 1 wherein the belt conveyor lighter has means thereon for discharging earth and sand conveyed from under water in at least two transverse paths.

17. The carry scraper ship according to claim 1 wherein the linking mean comprises means for linking the tug lighter and belt conveyor lighter so that the tug lighter tows the belt conveyor lighter as the tug lighter advances.

* * * * *